US011155096B2

(12) United States Patent
Sato et al.

(10) Patent No.: US 11,155,096 B2
(45) Date of Patent: Oct. 26, 2021

(54) LIQUID EJECTING UNIT AND LIQUID EJECTING APPARATUS

(71) Applicant: SEIKO EPSON CORPORATION, Tokyo (JP)

(72) Inventors: Masahiko Sato, Matsumoto (JP); Hiroyuki Hagiwara, Matsumoto (JP); Hironori Matsuoka, Matsumoto (JP); Hiroyuki Kobayashi, Azumino (JP); Takahiro Kanegae, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 16 days.

(21) Appl. No.: 16/886,224

(22) Filed: May 28, 2020

(65) Prior Publication Data

US 2020/0376847 A1 Dec. 3, 2020

(30) Foreign Application Priority Data

May 29, 2019 (JP) ..... JP2019-100416

(51) Int. Cl.
*B41J 2/175* (2006.01)

(52) U.S. Cl.
CPC ..... *B41J 2/17523* (2013.01)

(58) Field of Classification Search
CPC ..... B41J 2/17523; B41J 2202/07; B41J 2202/20; B41J 2202/19; B41J 2/175; B41J 2/14; B41J 2/14201; B41J 2/01; B41J 2/21; B41J 2002/14193
USPC ..... 347/86
See application file for complete search history.

(56) References Cited

U.S. PATENT DOCUMENTS 5,870,126 A * 2/1999 Kondo ..... B41J 2/18 347/92
2007/0126816 A1* 6/2007 Nishida ..... B41J 2/17556 347/85
2015/0224784 A1* 8/2015 Hong ..... B41J 2/14016 347/47
2017/0282587 A1* 10/2017 Koide ..... B41J 2/1652
2017/0305155 A1* 10/2017 Kanegae ..... B41J 2/19

FOREIGN PATENT DOCUMENTS

JP 2017-193132 10/2017

* cited by examiner

*Primary Examiner* — Huan H Tran
*Assistant Examiner* — Alexander D Shenderov
(74) *Attorney, Agent, or Firm* — Workman Nydegger

(57) ABSTRACT

A liquid ejecting unit includes: a first chamber; a second chamber; a third chamber; a fourth chamber; a first liquid passage for supplying a first type of liquid to the first chamber and the third chamber; a second liquid passage for supplying a second type of liquid to the second chamber and the fourth chamber, the second type of liquid differing from the first type of liquid; a first fluid passage for supplying fluid to the first chamber and the second chamber; and a second fluid passage for supplying the fluid to the third chamber and the fourth chamber.

9 Claims, 11 Drawing Sheets

LIQUID EJECTING UNIT AND LIQUID EJECTING APPARATUS

The present application is based on, and claims priority from JP Application Serial Number 2019-100416, filed May 29, 2019, the present disclosure of which is hereby incorporated by reference herein in its entirety.

BACKGROUND

1. Technical Field

The present disclosure relates to techniques of a liquid ejecting unit and a liquid ejecting apparatus.

2. Related Art

JP-A-2017-193132 discloses a liquid ejecting unit that includes: a storage space; a liquid passage through which liquid is supplied to the storage space; and a supply passage through which the liquid is discharged from the storage space. This storage space is separated into a first space and a second space by a sealing valve; the first space is coupled to the liquid passage, whereas the second space is coupled to the supply passage. When the liquid is supplied to the storage space through the fluid passage, it flows into the supply passage and then is discharged separately to the outside through two ejection opening rows. Moreover, the liquid ejecting unit includes a gas flow passage for use in opening the sealing valve. Through this gas flow passage, the inner pressure of a bag-shaped member disposed in the upper portion of the storage space is increased.

If two types of liquid are used in a liquid ejecting unit, it is necessary to provide two liquid ejecting units in relation to the respective types of liquid. In this case, a fluid passage, a supply passage, and a gas flow passage are provided for the storage space in which the first type of liquid is stored, and another fluid passage, supply passage, and gas flow passage are also provided for the storage space in which the second type of liquid is stored.

Suppose pressure cleaning using the first type of liquid is performed for a liquid ejecting unit in order to remove impurities from passages and corresponding ejection openings. First, through the gas flow passage, gas is supplied into the storage space for the first type of liquid, so that its inner pressure increases and the sealing valve is thereby opened. Then, pressurized liquid is supplied to the passage and the ejection openings through the fluid passage and the supply passage in this order. In this case, if the liquid ejecting unit is of a typical type in which two ejection opening rows are shared by a gas flow passage and a sealing valve for a first type of liquid, these ejection opening rows are cleaned simultaneously. Here, if the pressure cleaning is performed for a liquid ejecting unit in which an N number of ejection opening rows are provided for the first type of liquid, the pressure (N×Pn) is required to supply the pressurized liquid to these ejection opening rows, where Pn denotes the pressure required to clean one ejection opening row. To generate such high pressure, great drive power is required. If the pressure cleaning is performed for a liquid ejecting unit having multiple ejection opening rows at a low drive power such as Pn, the inner pressure of the passage leading to the ejection openings in each ejection opening row does not sufficiently increase, so that the pressure cleaning is not performed effectively. Although this disadvantage occurs during the pressure cleaning, similar disadvantages may also occur in any system in which a pressurizing mechanism that applies pressure to passages and corresponding ejection openings is disposed inside or outside the liquid ejecting unit.

SUMMARY

The present disclosure is a liquid ejecting unit that includes: a first chamber; a second chamber differing from the first chamber; a third chamber differing from the first chamber and the second chamber; and a fourth chamber differing from the first chamber, the second chamber, and the third chamber. Furthermore, the liquid ejecting unit includes: a first liquid passage through which a first type of liquid is supplied to both the first chamber and the third chamber; a second liquid passage through which a second type of liquid is supplied to both the second chamber and the fourth chamber, the second type of liquid differing from the first type of liquid; a first fluid passage through which fluid is supplied to both the first chamber and the second chamber; and a second fluid passage through which the fluid is supplied to both the third chamber and the fourth chamber.

DESCRIPTION OF EXEMPLARY EMBODIMENTS

First Embodiment

Figure 1:
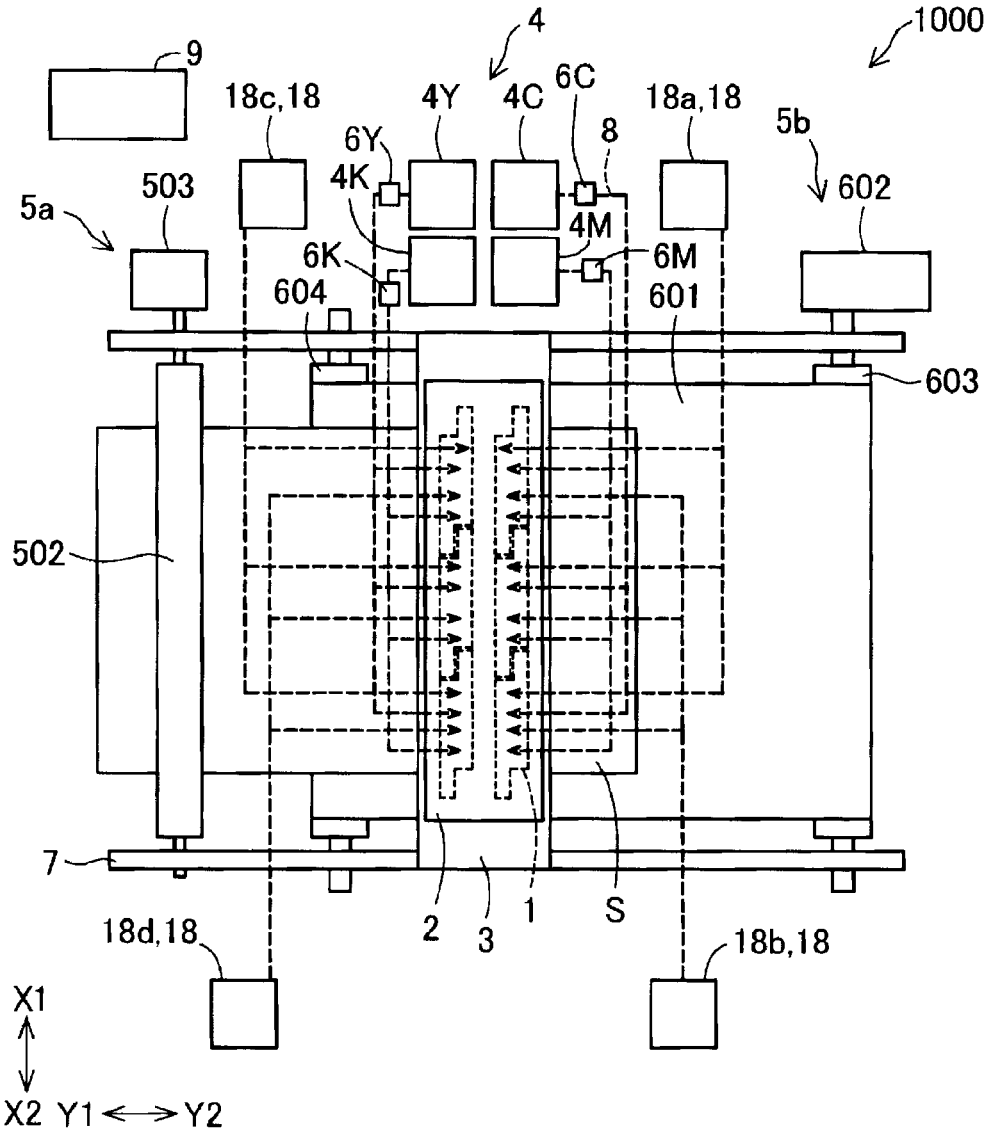
FIG. 1 is a top view of a schematic configuration of a liquid ejecting apparatus according to a first embodiment of the present disclosure.
Figure 2:
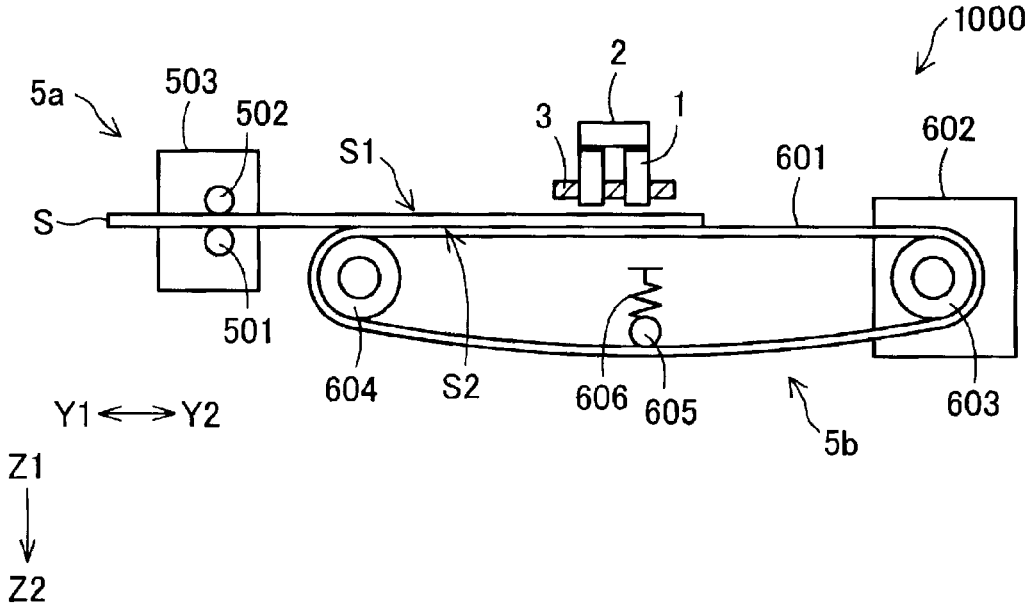
FIG. 2 is a side view of the liquid ejecting apparatus.

FIG. 1 is a top view of a schematic configuration of a liquid ejecting apparatus 1000 according to a first embodiment of the present disclosure; FIG. 2 is a side view of the liquid ejecting apparatus 1000. As illustrated in FIG. 1, the liquid ejecting apparatus 1000 may be a line type of ink jet recording apparatus that prints text, drawings, charts, graphs, or images, for example, on a medium or a recording sheet S while transporting it.

The liquid ejecting apparatus 1000 includes a plurality of liquid ejecting units 1; a supply member 2 that supplies a plurality of liquids to the liquid ejecting units 1; a support base 3 that supports the plurality of liquid ejecting units 1; liquid supply sources 4 that store the liquids; and at least one controller 9. Furthermore, the liquid ejecting apparatus 1000 includes transport mechanisms 5*a* and 5*b*, pressure regulators 18, and liquid pressurizing and feeding mechanisms 6C, 6M, 6Y, and 6K.

The plurality of liquid ejecting units 1 are held on the support base 3. Further, the liquid ejecting units 1 are arranged side by side in a plurality of rows, each of which extends in a direction orthogonal to the transport direction of the recording sheet S. In this embodiment, three liquid ejecting units 1 may constitute each row extending in directions X1 and X2. In addition, those rows are disposed parallel to each other in the transport direction of the recording sheet S. In this embodiment, two rows may be disposed in directions Y1 and Y2. The upstream side of the liquid ejecting apparatus 1000 in the transport direction is referred to as the Y1 side, whereas the downstream side is referred to as the Y2 side. Furthermore, all of the directions X1, X2, Y1, and Y2 are orthogonal to directions Z1 and Z2; the upper side of the liquid ejecting apparatus 1000 is referred to as the Z1 side, whereas the lower side is referred to the Z2 side. In this embodiment, the directions X1 or X2, Y1 or Y2, and Z1 or Z2 are orthogonal to one another; however, individual components of the liquid ejecting apparatus 1000 do not necessarily have to be arranged so as to be orthogonal to one another. The support base 3 are fixed to a main body 7; the plurality of liquid ejecting units 1 held by the support base 3 is fixed to the supply member 2, which supplies the liquids to the liquid ejecting units 1.

Each of the liquid supply sources 4, which may be a bottle, for example, is fixed to the main body 7. The liquid supply sources 4 supply the liquids to the supply member 2 through respective supply pipes 8, each of which may be formed of a tube, for example, and then the liquids reach the corresponding liquid ejecting units 1. The liquid supply sources 4 are disposed on the supply member 2. In this case, the liquid supply sources 4 may be mounted on the Z1-side surface of the supply member 2.

The liquid supply sources 4 include four liquid supply sources 4C, 4M, 4Y, and 4K that store different liquids. More specifically, the liquid supply source 4C stores the cyan liquid; the liquid supply source 4M stores the magenta liquid; the liquid supply source 4Y stores the yellow liquid; and the liquid supply source 4K stores the black liquid. For example, the cyan and magenta liquids may be supplied to the liquid ejecting units 1 arranged in one row extending in the directions X1 and X2, whereas the yellow and black liquids may be supplied to the liquid ejecting units 1 arranged in the other row.

Each of the four pressure regulators 18, which may be a pump, for example, selectively increases and decreases inner pressure of the passage disposed in the corresponding liquid ejecting unit 1. The pressure regulators 18 include a first pressure regulator 18*a*, a second pressure regulator 18*b*, a third pressure regulator 18*c*, and a fourth pressure regulator 18*d*. Both the first pressure regulator 18*a* and the second pressure regulator 18*b* supply pressurized fluid, or pressurized air, to the liquid ejecting units 1 arranged in one row extending in the directions X1 and X2. Likewise, both the third pressure regulator 18*c* and the fourth pressure regulator 18*d* supply pressurized fluid, or pressurized air, to the liquid ejecting units 1 arranged in the other row. The first pressure regulator 18*a*, the second pressure regulator 18*b*, the third pressure regulator 18*c*, and the fourth pressure regulator 18*d* may be disposed either inside or outside the respective liquid ejecting units 1.

The first liquid pressurizing and feeding mechanism 6C applies pressure to the cyan liquid stored in the liquid supply source 4C, thereby feeding the cyan liquid to the corresponding liquid ejecting units 1. The second liquid pressurizing and feeding mechanism 6M applies pressure to the magenta liquid stored in the liquid supply source 4M, thereby feeding the magenta liquid to the corresponding liquid ejecting units 1. The third liquid pressurizing and feeding mechanism 6Y applies pressure to the yellow liquid stored in the liquid supply source 4Y, thereby feeding the yellow liquid to the corresponding liquid ejecting units 1. The fourth liquid pressurizing and feeding mechanism 6K applies pressure to the black liquid stored in the liquid supply source 4K, thereby feeding the black liquid to the corresponding liquid ejecting units 1. Each of the first liquid pressurizing and feeding mechanism 6C, the second liquid pressurizing and feeding mechanism 6M, the third liquid pressurizing and feeding mechanism 6Y, and the fourth liquid pressurizing and feeding mechanism 6K, which may be a pump, for example, can be disposed either inside or outside the respective liquid ejecting units 1.

As illustrated in FIG. 2, the first transport mechanism 5*a*, which may be an example of a transport mechanism, is disposed in the liquid ejecting apparatus 1000 on the Y1 side. The first transport mechanism 5*a* includes: a first transport roller 501 rotated by means of power generated by a first drive motor 503; and a first driven roller 502 rotates together with the first transport roller 501. The first transport roller 501 is disposed on a rear surface S2 of the recording sheet S, which is opposite to a front surface S1 on which liquid droplets are to be placed, whereas the first driven roller 502 is disposed on the front surface S1 of the recording sheet S. Both the first transport roller 501 and the first driven roller 502 pinch the recording sheet S. The first driven roller 502 presses the recording sheet S against the first transport roller 501 by means of force generated by an unillustrated biasing member such as a spring.

The second transport mechanism 5*b*, which may be another example of the transport mechanism, is disposed in the liquid ejecting apparatus 1000 on the Y2 side, namely, downstream of the first transport mechanism 5*a*. The second transport mechanism 5*b* includes a transport belt 601, a second drive motor 602, a second transport roller 603, a second driven roller 604, and a tension roller 605, as illustrated in FIG. 2.

The second transport roller 603 is rotated by means of driving power generated by the second drive motor 602. The transport belt 601, which may be an endless belt, for example, runs between the second transport roller 603 and the second driven roller 604. The transport belt 601 is disposed below the rear surface S2 of the recording sheet S. The tension roller 605, which is disposed between the second transport roller 603 and the second driven roller 604, is kept in contact with the inner surface of the transport belt 601 while receiving biasing force from a biasing member 606 such as a spring, thereby applying tension to the transport belt 601. As a result, a portion of the transport belt 601 which is positioned between the second transport roller 603 and the second driven roller 604 and faces the liquid ejecting units 1 is maintained flat.

The controller 9 controls the operations of the liquid ejecting apparatus 1000 and the liquid ejecting units 1. More specifically, the controller 9 causes the liquid ejecting apparatus 1000 to discharge the liquids onto the front surface S1 of the recording sheet S while causing the first transport mechanism 5*a* and the second transport mechanism 5*b* to feed the recording sheet S from the Y1 side to Y2 side of each liquid ejecting unit 1. In this way, text, drawings, charts, graphs, or images, for example, are printed on the front surface S1 of the recording sheet S.

Figure 3:
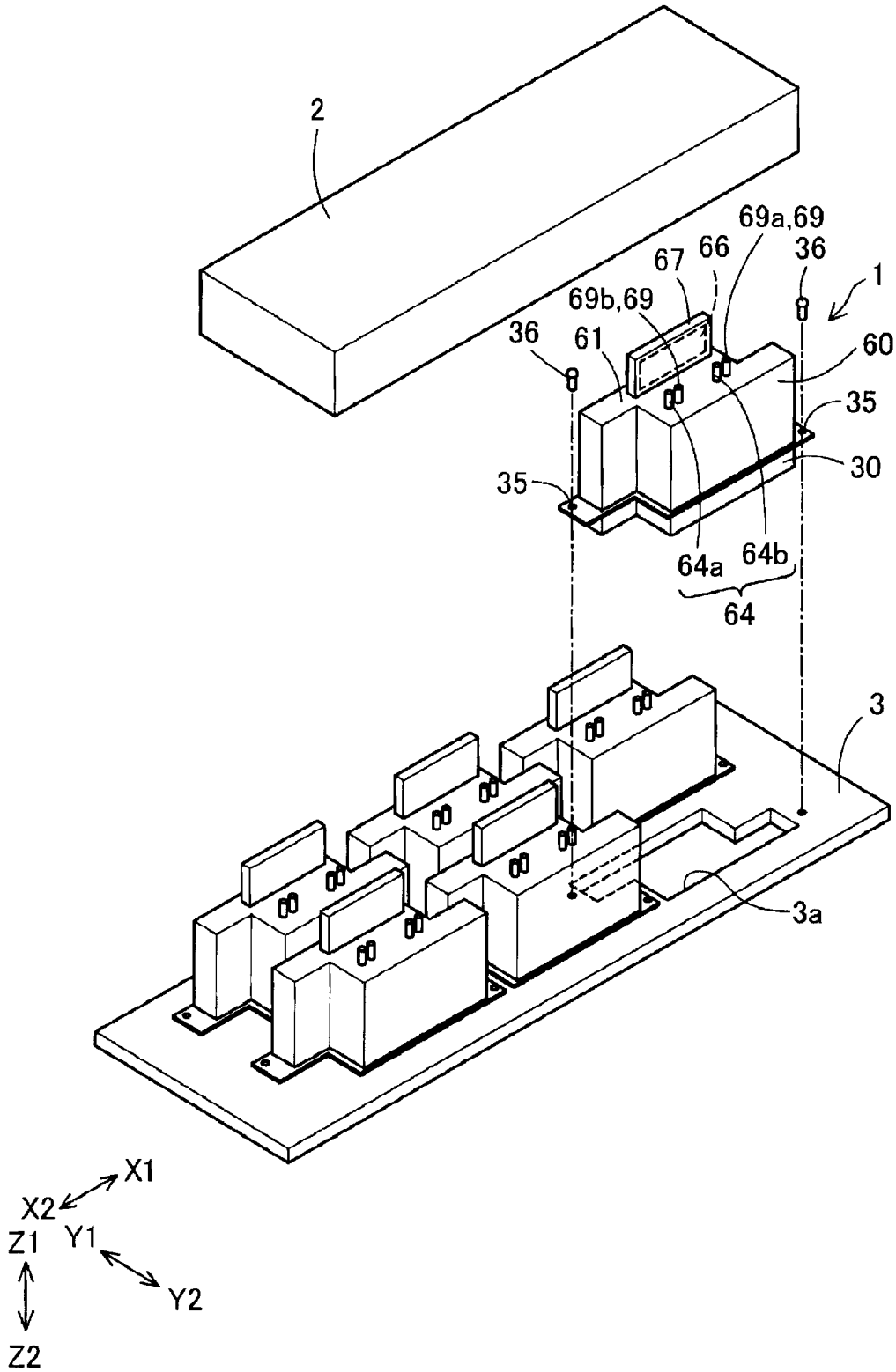
FIG. 3 is an exploded, perspective view of the liquid ejecting units and the support base.
Figure 4:
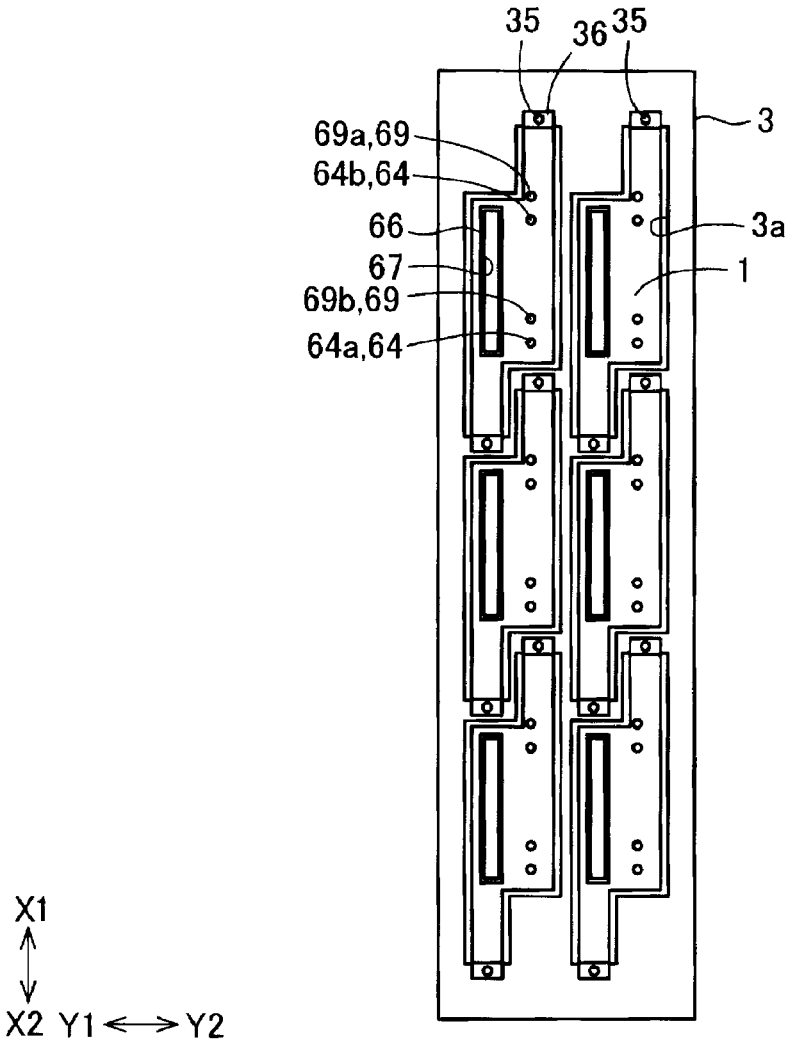
FIG. 4 is a top view of the liquid ejecting units and the support base.
Figure 5:
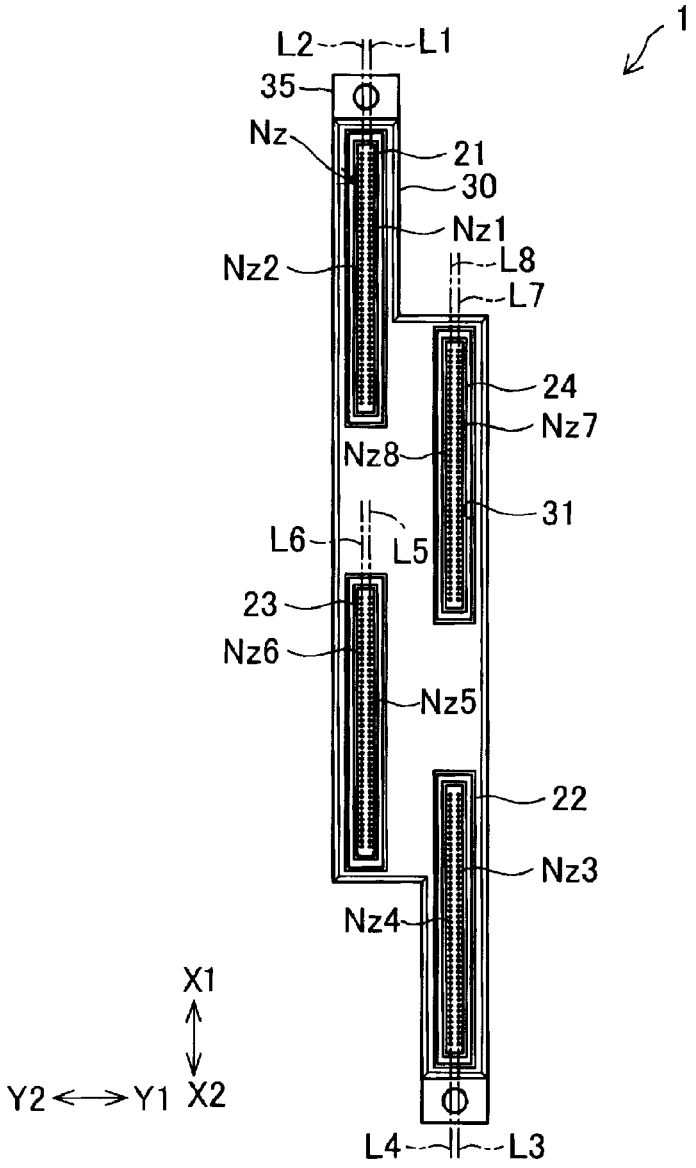
FIG. 5 is a bottom view of the liquid ejecting units.

FIG. 3 is an exploded, perspective view of the liquid ejecting units 1 and the support base 3; FIG. 4 is a top view of the liquid ejecting units 1 and the support base 3; and FIG. 5 is a bottom view of the liquid ejecting units 1. As illustrated in FIG. 3, the support base 3, which may be a flat member made of a conductive material such as metal, has a plurality of support openings 3*a* in which the respective liquid ejecting units 1 are held.

Each of the liquid ejecting units 1 includes: a flow-passage forming member 60 that forms a main body; a plurality of flanges 35; a holder 30; a first ejector 21; a second ejector 22; a third ejector 23; and a fourth ejector 24 (see FIG. 5). For example, each of the first ejector 21, the second ejector 22, the third ejector 23, and the fourth ejector 24 may be an ejection head. As illustrated in FIG. 3, the flanges 35 are fixed to the support base 3 with screws 36. The flow-passage forming member 60 disposed on the Z1-side surface of the holder 30 includes: a connector member 67 disposed on an upper surface 61 of the flow-passage forming member 60; and a plurality of liquid inlets 64 and a plurality of fluid inlets 69 disposed on the upper surface 61. As illustrated in FIG. 5, the holder 30, to which the first ejector 21, the second ejector 22, the third ejector 23, and the fourth ejector 24 are fixed, includes four storage sections 31 each of which has a recessed shape. The first ejector 21 to the fourth ejector 24 are accommodated and fixed in the respective storage sections 31. Each of the first ejector 21 to the fourth ejector 24, which may have a rectangular parallelepiped shape, has a plurality of ejection openings Nz.

Each of the first ejector 21 to the fourth ejector 24 has two ejection opening rows arranged parallel to each other in the directions Y1 and Y2. More specifically, the first ejector 21 has a first ejection opening row L1 and a second ejection opening row L2; the second ejector 22 has a third ejection opening row L3 and a fourth ejection opening row L4; the third ejector 23 has a fifth ejection opening row L5 and a sixth ejection opening row L6; and the fourth ejector 24 has a seventh ejection opening row L7 and an eighth ejection opening row L8. Each of the first ejection opening row L1 to the eighth ejection opening row L8 includes the plurality of ejection openings Nz arrayed in the directions X1 and X2. In this embodiment, each of the first ejection opening row L1 to the eighth ejection opening row L8 may include 400 ejection openings Nz.

The ejection openings Nz in the first ejection opening row L1 may be referred to as the first ejection openings Nz1; the ejection openings Nz in the second ejection opening row L2 may be referred to as the second ejection opening Nz2; the ejection openings Nz in the third ejection opening row L3 may be referred to as the third ejection opening Nz3; the ejection openings Nz in the fourth ejection opening row L4 may be referred to as the fourth ejection opening Nz4; the ejection openings Nz in the fifth ejection opening row L5 may be referred to as the fifth ejection opening Nz5; the ejection openings Nz in the sixth ejection opening row L6 may be referred to as the sixth ejection opening Nz6; the ejection openings Nz in the seventh ejection opening row L7 may be referred to as the seventh ejection opening Nz7; and the ejection openings Nz in the eighth ejection opening row L8 may be referred to as the eighth ejection opening Nz8. In this embodiment, a first type of liquid and a second type of liquid that differ from each other may be used. The first type of liquid may be discharged through the first ejection opening row L1, the third ejection opening row L3, the fifth ejection opening row L5, and the seventh ejection opening row L7, whereas the second type of liquid may be discharged through the second ejection opening row L2, the fourth ejection opening row L4, the sixth ejection opening row L6, and the eighth ejection opening row L8. For example, the first type of liquid may differ in color from the second type of liquid; the first type of liquid may be a cyan or yellow liquid, whereas the second type of liquid may be a magenta or black liquid.

As illustrated in FIG. 3, the connector member 67 has a circuit substrate 66 that is electrically connected, via a wire, to the controller 9 in the liquid ejecting apparatus 1000. In addition, the circuit substrate 66 is electrically connected, via a wire, to energy generating elements disposed inside the first ejector 21 to the fourth ejector 24. The circuit substrate 66 controls the operations of the energy generating elements in accordance with signals from the controller 9 in the liquid ejecting apparatus 1000. The circuit substrate 66 does not necessarily have to be disposed in the connector member 67; alternatively, the circuit substrate 66 may be disposed outside the connector member 67. As an example, each energy generating element may be a piezoelectric element that applies varying pressure to the corresponding liquid, thereby discharging the liquid through the ejection openings Nz. As an alternative example, each energy generating element may be an electrothermal element that generates thermal energy to cause the film-boiling of the liquid in the ejection openings Nz, thereby discharging the liquid through the ejection openings Nz.

The liquid inlets 64 include a first liquid inlet 64*a* and a second liquid inlet 64*b*, each of which may be a cylindrical member, for example. The first liquid inlet 64*a* and the second liquid inlet 64*b* are supplied with different liquids, (liquids of different colors in this embodiment) through the supply pipes 8. For example, in each of the liquid ejecting units 1 disposed adjacent to the Y2 side, the liquid supply source 4C may supply the cyan liquid to the first liquid inlet 64*a*, and the liquid supply source 4M may supply the magenta liquid to the second liquid inlet 64*b*.

The fluid inlets 69 include a first fluid inlet 69*a* and a second fluid inlet 69*b* that are coupled to respective fluid passages formed inside the flow-passage forming member 60. For example, in each of the liquid ejecting units 1 disposed closer to the Y2 side, the first pressure regulator 18*a* may supply pressurized air to the first fluid inlet 69*a*, and the second pressure regulator 18*b* may supply pressurized air to the second fluid inlet 69*b*. Likewise, in each of the liquid ejecting units 1 disposed adjacent to the Y1 side, the third pressure regulator 18*c* may supply pressurized air to the first fluid inlet 69*a*, and the fourth pressure regulator 18*d* may supply pressurized air to the second fluid inlet 69*b*. The pressurized air supplied to the first fluid inlet 69*a* and the second fluid inlet 69*b* is used to open the sealing valves in the liquid passages inside the flow-passage forming member 60. The first fluid inlet 69*a* may be used to open the sealing valves disposed in the liquid passages leasing to the ejection openings Nz in the first ejector 21 and the fourth ejector 24. Likewise, the second fluid inlet 69*b* may be used to open the sealing valves disposed in the liquid passages leasing to the ejection openings Nz in the second ejector 22 and the third ejector 23. Details of these operations will be described later.

Figure 6:
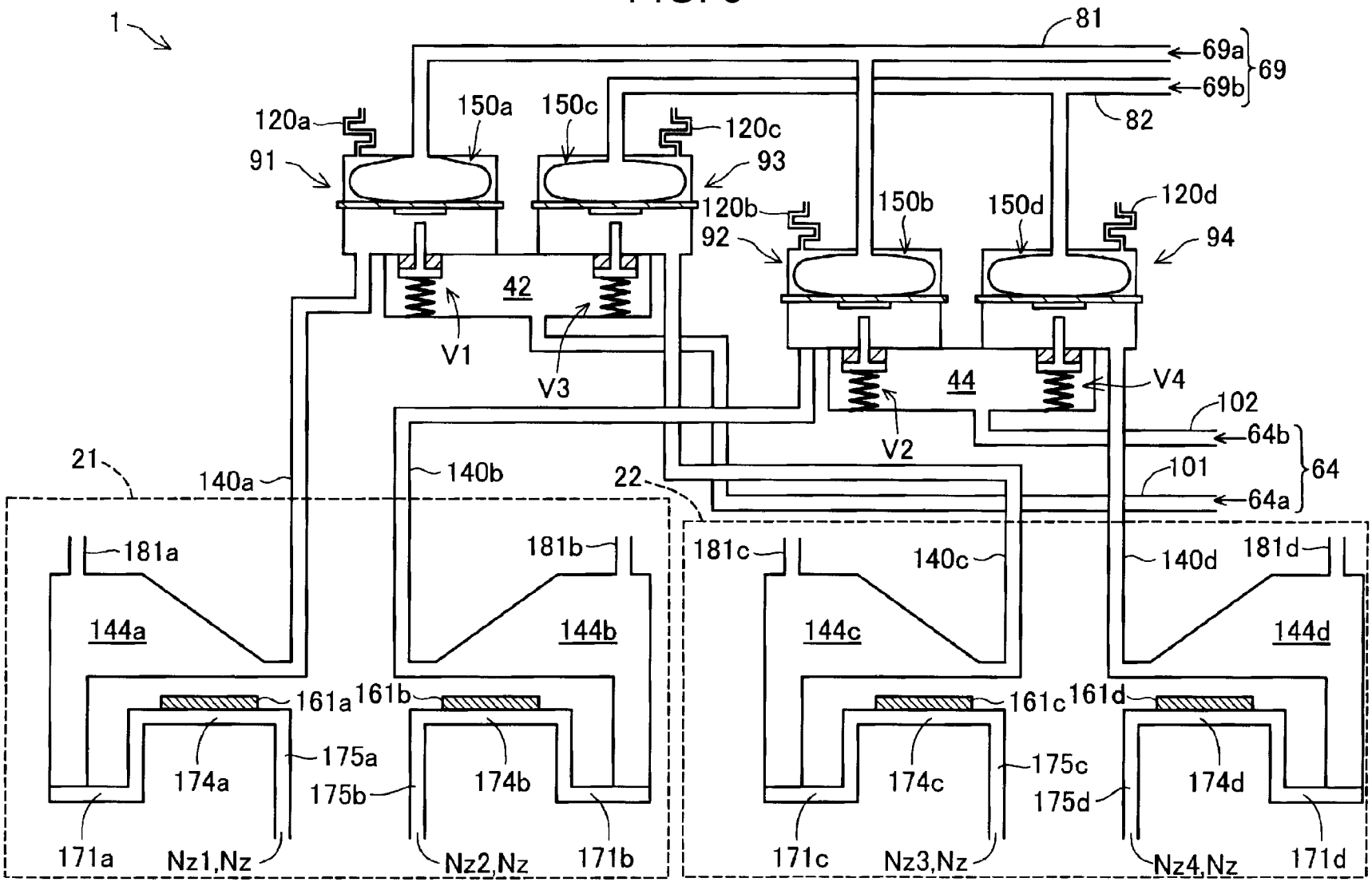
FIG. 6 illustrates an internal configuration of a liquid ejecting unit.
Figure 7:
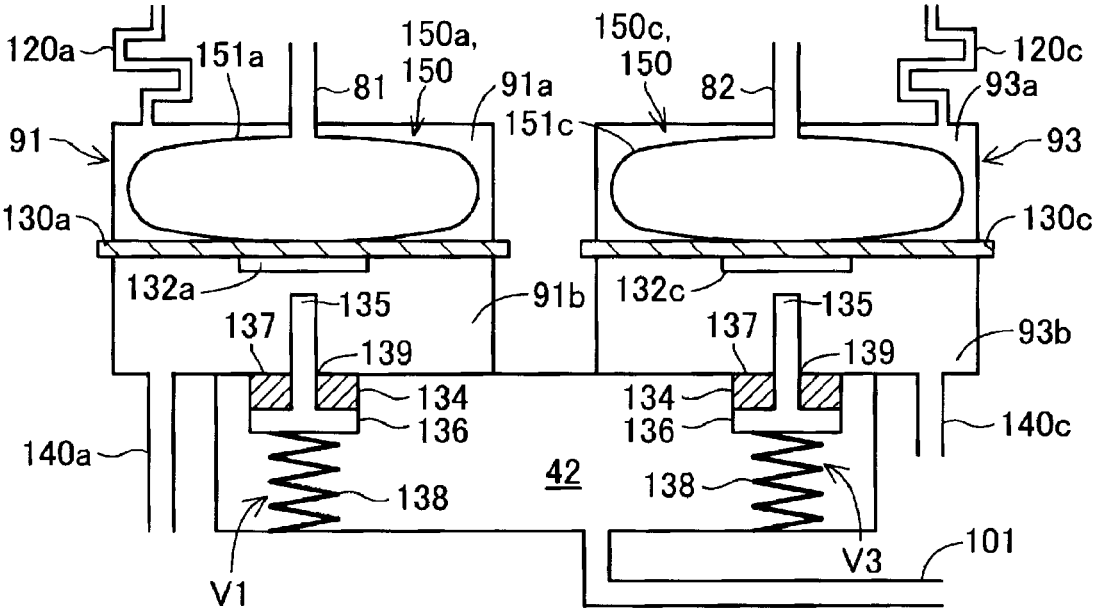
FIG. 7 illustrates details of the internal configuration of the liquid ejecting unit.
Figure 8:
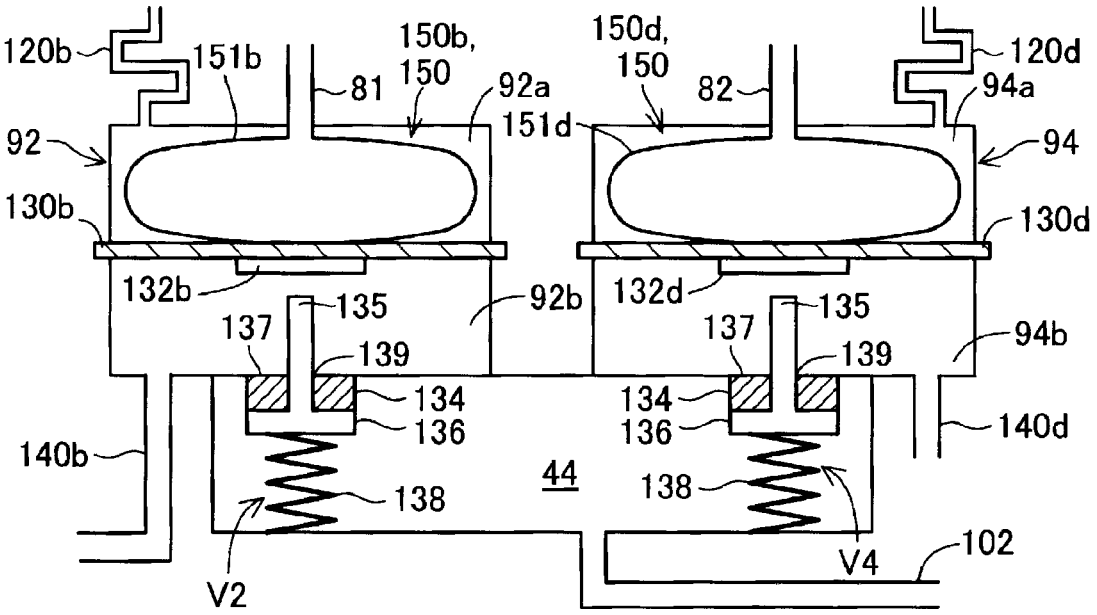
FIG. 8 illustrates details of the internal configuration of the liquid ejecting unit.
Figure 9:
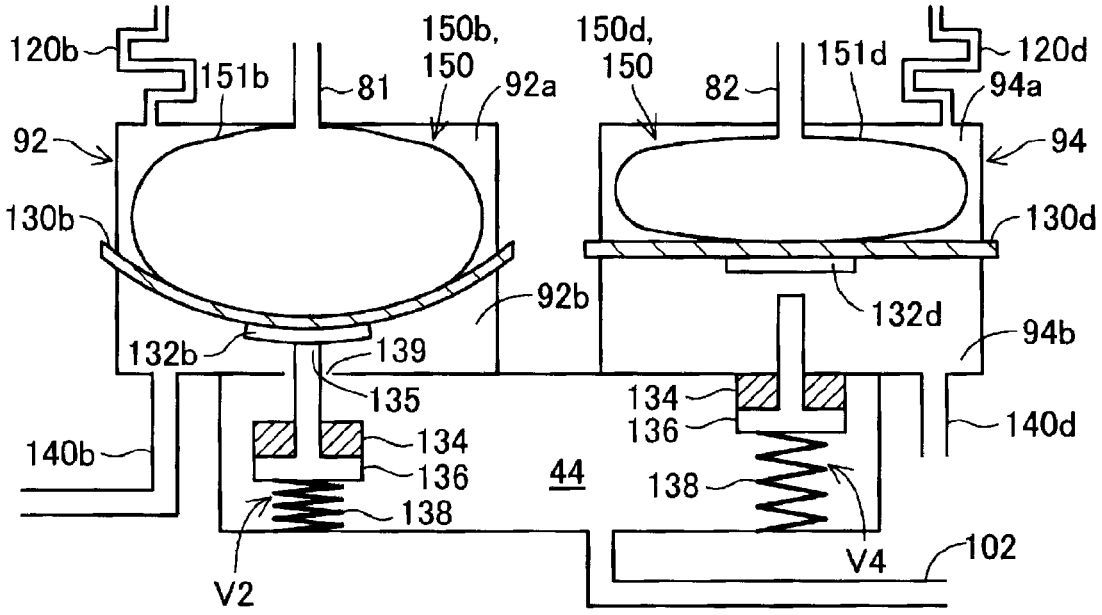
FIG. 9 illustrates details of the internal configuration of the liquid ejecting unit.

FIG. 6 illustrates an internal configuration of a liquid ejecting unit 1; FIG. 7 illustrates details of a first chamber 91, a third chamber 93, and some adjacent parts in the liquid ejecting unit 1; FIG. 8 illustrates details of a second chamber 92, a fourth chamber 94, and some adjacent parts in the liquid ejecting unit 1; and FIG. 9 illustrates details of the second chamber 92, the fourth chamber 94, and some adjacent parts in the liquid ejecting unit 1 when fluid is supplied to a first fluid passage 81. It should be noted that FIGS. 6 to 9 illustrate only the configuration related to the first ejector 21 and the second ejector 22 in the liquid ejecting unit 1.

As illustrated in FIG. 6, the liquid ejecting unit 1 is provided with the first chamber 91, the second chamber 92, the third chamber 93, and the fourth chamber 94 disposed at different locations. As illustrated in FIG. 7, the first chamber 91 has a first opening/closing mechanism 150*a* that opens and closes a first sealing valve V1, whereas the third chamber 93 has a third opening/closing mechanism 150*c* that opens and closes a third sealing valve V3. As illustrated in FIG. 8, the second chamber 92 has a second opening/closing mechanism 150*b* that opens and closes a second sealing valve V2, whereas the fourth chamber 94 has a fourth opening/closing mechanism 150*d* that opens and closes a fourth sealing valve V4.

As illustrated in FIGS. 7 and 8, the first opening/closing mechanism 150*a* to the fourth opening/closing mechanism 150*d* have substantially the same configuration. The first opening/closing mechanism 150*a* includes a first flexible section 130*a*, a first bag 151*a*, and a first pressure receiving plate 132*a*. The second opening/closing mechanism 150*b*, which has substantially the same configuration as the first opening/closing mechanism 150*a*, includes a second flexible section 130*b*, a second bag 151*b*, and a second pressure receiving plate 132*b*. The third opening/closing mechanism 150*c*, which has substantially the same configuration as the first opening/closing mechanism 150*a*, includes a third flexible section 130*c*, a third bag 151*c*, and a third pressure receiving plate 132*c*. The fourth opening/closing mechanism 150*d*, which has substantially the same configuration as the first opening/closing mechanism 150*a*, includes a fourth flexible section 130*d*, a fourth bag 151*d*, and a fourth pressure receiving plate 132*d*.

Each of the first flexible section 130*a* to the fourth flexible section 130*d* may be any member having flexibility. For example, each of the first flexible section 130*a* to the fourth flexible section 130*d* may be a flexible film or plate. As illustrated in FIG. 7, the periphery of the first flexible section 130*a* is fixed to the wall that defines the first chamber 91. The first flexible section 130*a* partitions the first chamber 91 into a first fluid chamber 91*a* and a first liquid chamber 91*b*. Likewise, the periphery of the third flexible section 130*c* is fixed to the wall that defines the third chamber 93. The third flexible section 130*c* partitions the third chamber 93 into a third fluid chamber 93*a* and a third liquid chamber 93*b*. As illustrated in FIG. 8, the periphery of the second flexible section 130*b* is fixed to the wall that defines the second chamber 92. The second flexible section 130*b* partitions the second chamber 92 into a second fluid chamber 92*a* and a second liquid chamber 92*b*. The periphery of the fourth flexible section 130*d* is fixed to the wall that defines the fourth chamber 94. The fourth flexible section 130*d* partitions the fourth chamber 94 into a fourth fluid chamber 94*a* and a fourth liquid chamber 94*b*.

Each of the first bag 151*a* to the fourth bag 151*d*, which may be a bag-shaped member made of an elastic material such as rubber, expands when the pressure of the inner space increases and shrinks when the pressure of the inner space decreases. Both the first bag 151*a* and the second bag 151*b* lead to the first fluid inlet 69*a*. The first pressure regulator 18*a* selectively performs a first operation and a second operation; in the first operation, the pressurized air is supplied to the liquid ejecting unit 1 through the first fluid inlet 69*a*, whereas in the second operation, the air is sucked from the liquid ejecting unit 1 through the first fluid inlet 69*a*. As a result of the first operation, both the first bag 151*a* and the second bag 151*b* expand. The expanding of the first bag 151*a* causes the first flexible section 130*a* to be warped toward the first sealing valve V1 that will be described later. The expanding of the second bag 151*b* causes the second flexible section 130*b* to be warped toward the second sealing valve V2 that will be described later. Likewise, as a result of the second operation, both the first bag 151*a* and the second bag 151*b* shrink. The shrinking of the first bag 151*a* causes the first flexible section 130*a* to be warped apart from the first sealing valve V1. The shrinking of the second bag 151*b* causes the second flexible section 130*b* to be warped apart from the second sealing valve V2.

Both the third bag 151*c* and the fourth bag 151*d* lead to the second fluid inlet 69*b*. The second pressure regulator 18*b* selectively performs a first operation and a second operation; in the first operation, the pressurized air is supplied to the liquid ejecting unit 1 through the second fluid inlet 69*b*, whereas in the second operation, the air is sucked from both the liquid ejecting unit 1 through the second fluid inlet 69*b*. As a result of the first operation, both the third bag 151*c* and the fourth bag 151*d* expand. The expanding of the third bag 151*c* causes the third flexible section 130*c* to be warped toward the third sealing valve V3 that will be described later. The expanding of the fourth bag 151*d* causes the fourth flexible section 130*d* to be warped toward the fourth sealing valve V4 that will be described later. Likewise, as a result of the second operation, both the third bag 151*c* and the fourth bag 151*d* shrink. The shrinking of the third bag 151*c* causes the third flexible section 130*c* to be warped apart from the third sealing valve V3. The shrinking of the fourth bag 151*d* causes the fourth flexible section 130*d* to be warped apart from the fourth sealing valve V4.

Each of the first pressure receiving plate 132*a* to the fourth pressure receiving plate 132*d* may be a substantially disc-shaped member. As illustrated in FIG. 7, the first pressure receiving plate 132*a* is disposed inside the first liquid chamber 91*b* and on the portion of the first flexible section 130*a* which faces a valve shaft 135 of the first sealing valve V1. Likewise, the third pressure receiving plate 132*c* is disposed inside the third liquid chamber 93*b* and on the portion of the third flexible section 130*c* which faces a valve shaft 135 of the third sealing valve V3. As illustrated in FIG. 8, the second pressure receiving plate 132*b* is disposed inside the second liquid chamber 92*b* and on the portion of the second flexible section 130*b* which faces a valve shaft 135 of the second sealing valve V2. Likewise, the fourth pressure receiving plate 132*d* is disposed inside the fourth liquid chamber 94*b* and on the portion of the fourth flexible section 130*d* which faces a valve shaft 135 of the fourth sealing valve V4.

As illustrated in FIG. 6, the liquid ejecting unit 1 further includes a first liquid passage 101, a second liquid passage 102, the first fluid passage 81, and a second fluid passage 82, in addition to the above first sealing valve V1 to the fourth sealing valve V4.

The first fluid passage 81 is provided with the first fluid inlet 69*a* at its upstream end and is divided at its midway into two sub-passages: one is coupled at the downstream end to the first fluid chamber 91*a* in the first chamber 91, and the other is coupled at the downstream end to the second fluid chamber 92*a* in the second chamber 92. In short, the first fluid passage 81 is coupled to both the first fluid chamber 91*a* in the first chamber 91 and the second fluid chamber 92*a* in the second chamber 92, so that fluid, or the pressurized air, can be supplied to both the first fluid chamber 91*a* and the second fluid chamber 92*a*.

The second fluid passage 82 is provided with the second fluid inlet 69*b* at its upstream end and is divided at its midway into two sub-passages: one is coupled at the downstream end to the third fluid chamber 93*a* in the third chamber 93, and the other is coupled at the downstream end to the fourth fluid chamber 94*a* in the fourth chamber 94. In short, the second fluid passage 82 is coupled to both the third fluid chamber 93*a* in the third chamber 93 and the fourth fluid chamber 94*a* in the fourth chamber 94, so that fluid, or the pressurized air, can be supplied to both the third fluid chamber 93*a* and the fourth fluid chamber 94*a*.

The upstream end of the first liquid passage 101 is provided with the first liquid inlet 64*a*, whereas the downstream end of the first liquid passage 101 is coupled to a first placement chamber 42. The first liquid passage 101 couples the first liquid inlet 64*a* to both the first liquid chamber 91*b* in the first chamber 91 and the third liquid chamber 93*b* in the third chamber 93. Through the first liquid inlet 64*a* and the first liquid passage 101, the first type of liquid can be supplied to both the first liquid chamber 91*b* in the first chamber 91 and the third liquid chamber 93*b* in the third chamber 93. The first placement chamber 42 contains the first sealing valve V1 and the third sealing valve V3. Herein, the space defined by the first placement chamber 42, the first liquid chamber 91*b*, and the third liquid chamber 93*b* may be referred to as the storage space for the first type of liquid.

The upstream end of the second liquid passage 102 is provided with the second liquid inlet 64*b*, whereas the downstream end of the second liquid passage 102 is coupled to a second placement chamber 44. The second liquid passage 102 couples the second liquid inlet 64*b* to both the second liquid chamber 92*b* in the second chamber 92 and the fourth liquid chamber 94*b* in the fourth chamber 94. Through the second liquid inlet 64*b* and the second liquid passage 102, the second type of liquid can be supplied to both the second liquid chamber 92*b* in the second chamber 92 and the fourth liquid chamber 94*b* in the fourth chamber 94. The second placement chamber 44 contains the second sealing valve V2 and the fourth sealing valve V4. Herein, the space defined by the second placement chamber 44, the second liquid chamber 92*b*, and the fourth liquid chamber 94*b* may be referred to as the storage space for the second type of liquid.

As illustrated in FIGS. 7 and 8, the first sealing valve V1 to the fourth sealing valve V4 have substantially the same configuration. Each of the first sealing valve V1 to the fourth sealing valve V4 includes a valve body 136, a seal section 134, the valve shaft 135, a biasing member 138, and a valve seat 137.

The valve seat 137 has a valve hole 139. As illustrated in FIG. 7, the first liquid chamber 91*b* communicates with the first placement chamber 42 through the valve hole 139 in the first sealing valve V1, and the third liquid chamber 93*b* also communicates with the first placement chamber 42 through the valve hole 139 in the third sealing valve V3. As illustrated in FIG. 8, the second liquid chamber 92*b* communicates with the second placement chamber 44 through the valve hole 139 in the second sealing valve V2, and the fourth liquid chamber 94*b* also communicates with the second placement chamber 44 through the valve hole 139 in the fourth sealing valve V4.

The valve body 136 has a disc shape; the seal section 134, which may be an elastic member, for example, is bonded to the valve body 136 and covers the valve hole 139; and the valve shaft 135, which may be a rod-shaped member, for example, is coupled to the valve body 136. As illustrated in FIG. 7, the end of the valve shaft 135 in the first sealing valve V1 is disposed inside the first liquid chamber 91*b* while facing the first pressure receiving plate 132*a*. Likewise, the end of the valve shaft 135 in the third sealing valve V3 is disposed inside the third liquid chamber 93*b* while facing the third pressure receiving plate 132*c*. As illustrated in FIG. 8, the end of the valve shaft 135 in the second sealing valve V2 is disposed inside the second liquid chamber 92*b* while facing the second pressure receiving plate 132*b*. Likewise, the end of the valve shaft 135 in the fourth sealing valve V4 is disposed inside the fourth liquid chamber 94*b* while facing the fourth pressure receiving plate 132*d*.

The biasing member 138, which may be a spring, biases the valve body 136 toward the valve seat 137 by pressing the valve body 136 against the valve seat 137.

When the pressurized air is supplied to the first bag 151*a* through the first fluid passage 81, the first bag 151*a* expands. Then, the first bag 151*a* pushes the first flexible section 130*a* in the first chamber 91 toward the first sealing valve V1. The first flexible section 130*a* is thereby warped toward the valve shaft 135 in the first sealing valve V1. In short, when being supplied to the first bag 151*a* through the first fluid passage 81, the pressurized air causes the first flexible section 130*a* to be warped. In this case, the first pressure receiving plate 132*a* applies external force to the valve shaft 135 against the biasing force of the biasing member 138 so that the seal section 134 moves apart from the valve hole 139. Consequently, the seal section 134 stops covering the valve hole 139, thereby causing the first liquid chamber 91*b* to communicate with the first liquid passage 101. In this way, in response to the warping of the first flexible section 130*a*, the first sealing valve V1 switches between the state in which the first liquid passage 101 communicates with the first liquid chamber 91*b* in the first chamber 91 and the state in which the first liquid passage 101 does not communicate with the first liquid chamber 91*b* in the first chamber 91.

When the pressurized air is supplied to the second bag 151*b* through the first fluid passage 81, the second bag 151*b* expands. Then, the second bag 151*b* pushes the second flexible section 130*b* in the second chamber 92 toward the second sealing valve V2. The second flexible section 130*b* is thereby warped toward the valve shaft 135 in the second sealing valve V2. In short, when being supplied to the second bag 151*b* through the first fluid passage 81, the pressurized air causes the second flexible section 130*b* to be warped. In this case, the second pressure receiving plate 132*b* applies external force to the valve shaft 135 against the biasing force of the biasing member 138 so that the valve shaft 135 moves apart from valve hole 139. Consequently, the seal section 134 stops covering the valve hole 139, thereby causing the second liquid chamber 92*b* to communicate with the second liquid passage 102. In this way, in response to the warping of the second flexible section 130*b*, the second sealing valve V2 switches between the state in which the second liquid passage 102 communicates with the second liquid chamber 92*b* in the second chamber 92 and the state in which the second liquid passage 102 does not communicate with the second liquid chamber 92*b* in the second chamber 92.

When the pressurized air is supplied to the third bag 151*c* through the second fluid passage 82, the third bag 151*c* expands. Then, the third bag 151*c* pushes the third flexible section 130*c* in the third chamber 93 toward the third sealing valve V3. The third flexible section 130*c* is thereby warped toward the valve shaft 135 in the third sealing valve V3. In short, when being supplied to the third bag 151*c* through the second fluid passage 82, the pressurized air causes the third flexible section 130*c* to be warped. In this case, the third pressure receiving plate 132*c* applies external force to the valve shaft 135 against the biasing force of the biasing member 138 so that the seal section 134 moves apart from the valve hole 139. Consequently, the seal section 134 stops covering the valve hole 139, thereby causing the third liquid chamber 93*b* to communicate with the first liquid passage 101. In this way, in response to the warping of the third flexible section 130*c*, the third sealing valve V3 switches between the state in which the first liquid passage 101 communicates with the third liquid chamber 93*b* in the third chamber 93 and the state in which the first liquid passage 101 does not communicate with the third liquid chamber 93*b* in the third chamber 93.

When the pressurized air is supplied to the fourth bag 151*d* through the second fluid passage 82, the fourth bag 151*d* expands. Then, the fourth bag 151*d* pushes the fourth flexible section 130*d* in the fourth chamber 94 toward the fourth sealing valve V4. The fourth flexible section 130*d* is thereby warped toward the valve shaft 135 in the fourth sealing valve V4. In short, when being supplied to the fourth bag 151*d* through the second fluid passage 82, the pressurized air causes the fourth flexible section 130*d* to be warped. In this case, the fourth pressure receiving plate 132*d* applies external force to the valve shaft 135 against the biasing force of the biasing member 138 so that the seal section 134 moves apart from the valve hole 139. Consequently, the seal section 134 stops covering the valve hole 139, thereby causing the fourth liquid chamber 94*b* to communicate with the second liquid passage 102. In this way, in response to the warping of the fourth flexible section 130*d*, the fourth sealing valve V4 switches between the state in which the second liquid passage 102 communicates with the fourth liquid chamber 94*b* in the fourth chamber 94 and the state in which the second liquid passage 102 does not communicate with the fourth liquid chamber 94*b* in the fourth chamber 94.

As described above, the first chamber 91 contains the first liquid chamber 91*b* coupled to the first liquid passage 101 and the first fluid chamber 91*a* coupled to the first fluid passage 81; the first liquid chamber 91*b* is separated from the first fluid chamber 91*a* by the first flexible section 130*a*. The second chamber 92 contains the second liquid chamber 92*b* coupled to the second liquid passage 102 and the second fluid chamber 92*a* coupled to the first fluid passage 81; the second liquid chamber 92*b* is separated from the second fluid chamber 92*a* by the second flexible section 130*b*. The third chamber 93 contains the third liquid chamber 93*b* coupled to the first liquid passage 101 and the third fluid chamber 93*a* coupled to the second fluid passage 82; the third liquid chamber 93*b* is separated from the third fluid chamber 93*a* by the third flexible section 130*c*. The fourth chamber 94 contains the fourth liquid chamber 94*b* coupled to the second liquid passage 102 and the fourth fluid chamber 94*a* coupled to the second fluid passage 82; the fourth liquid chamber 94*b* is separated from the fourth fluid chamber 94*a* by the fourth flexible section 130*d*.

As illustrated in FIGS. 7 and 8, each liquid ejecting unit 1 further includes a first exposure-to-air passage 120*a*, a second exposure-to-air passage 120*b*, a third exposure-to-air passage 120*c*, and a fourth exposure-to-air passage 120*d*, all of which are disposed inside the flow-passage forming member 60. Through the first exposure-to-air passage 120*a* disposed in the flow-passage forming member 60, the first fluid chamber 91*a* communicates with the outside. The first exposure-to-air passage 120*a* is curved several times in order to suppress the liquid in the first liquid chamber 91*b* from vaporizing and flowing out through the first flexible section 130*a*. Through the second exposure-to-air passage 120*b* disposed in the flow-passage forming member 60, the second fluid chamber 92*a* communicates with the outside. The second exposure-to-air passage 120*b* is curved several times in order to suppress the liquid in the second liquid chamber 92*b* from vaporizing and flowing out through the second flexible section 130*b*. Through the third exposure-to-air passage 120*c* disposed in the flow-passage forming member 60, the third fluid chamber 93*a* communicates with the outside. The third exposure-to-air passage 120*c* is curved several times in order to suppress the liquid in the third liquid chamber 93*b* from vaporizing and flowing out through the third flexible section 130*c*. Through the fourth exposure-to-air passage 120*d* disposed in the flow-passage forming member 60, the fourth fluid chamber 94*a* communicates with the outside. The fourth exposure-to-air passage 120*d* is curved several times in order to suppress the liquid in the fourth liquid chamber 94*b* from vaporizing and flowing out through the fourth flexible section 130*d*.

As illustrated in FIG. 7, the first fluid chamber 91*a* and the third fluid chamber 93*a* do not communicate with each other and are separated from each other by an unillustrated wall of the flow-passage forming member 60. As illustrated in FIG. 8, the second fluid chamber 92*a* and the fourth fluid chamber 94*a* do not communicate with each other and are separated from each other by an unillustrated wall of the flow-passage forming member 60.

As illustrated in FIG. 9, the second fluid chamber 92*a* and the fourth fluid chamber 94*a* for use in supplying the same type of liquid to corresponding ejection openings Nz do not communicate with and thus are separated from each other. Likewise, the first fluid chamber 91*a* and the third fluid chamber 93*a* for use in supplying the same type of liquid to corresponding ejection openings Nz do not communicate with and thus are separated from each other. Therefore, even if the inner pressure of one of the first fluid chamber 91*a*, the second fluid chamber 92*a*, the third fluid chamber 93*a*, and the fourth fluid chamber 94*a* varies, others are less likely to be affected. As one example, when the second bag 151*b* is supplied with the pressurized air and thereby expands as illustrated in FIG. 9, the air in the second fluid chamber 92*a* would flow to the outside through the second exposure-to-air passage 120*b*. However, the curved shape of the second exposure-to-air passage 120*b* prohibits the air from flowing out smoothly, so that the inner pressure of the second fluid chamber 92*a* temporarily increases. In this case, if the second fluid chamber 92*a* communicates with the fourth fluid chamber 94*a*, the inner pressure of the fourth fluid chamber 94*a* would also increase, and the fourth flexible section 130*d* would be warped toward the fourth liquid chamber 94*b*, thereby increasing the inner pressure of the fourth liquid chamber 94*b*. As another example, if the second bag 151*b* shrinks because of the stopping of the pressurized air supply, external air would flow into the second liquid chamber 92*b* through the second exposure-to-air passage 120*b*. However, the curved shape of the second exposure-to-air passage 120*b* prohibits external air from flowing into the second liquid chamber 92*b* smoothly, so that the inner pressure of the second fluid chamber 92*a* temporarily decreases. In this case, if the second fluid chamber 92*a* communicates with the fourth fluid chamber 94*a*, the inner pressure of the fourth fluid chamber 94*a* would also decrease. As described above, if the second fluid chamber 92*a* communicates with the fourth fluid chamber 94*a*, a varying inner pressure of the second fluid chamber 92*a* might affect the fourth fluid chamber 94*a* so that the first flexible section 130*a* is warped, thereby varying the inner pressure of the fourth liquid chamber 94*b* defined by the fourth flexible section 130*d*. This might damage the menisci in the corresponding ejection openings Nz through the fourth liquid chamber 94*b*. Likewise, if the first fluid chamber 91*a* communicates with the third fluid chamber 93*a*, a varying inner pressure of the first fluid chamber 91*a* might affect the third fluid chamber 93*a* so that the fourth flexible section 130*d* is warped, thereby varying the inner pressure of the first liquid chamber 91*b* defined by the first flexible section 130*a*. This might damage the menisci in the corresponding ejection openings Nz through the first liquid chamber 91*b*. In contrast with the above, in this embodiment, the first chamber 91 does not communicate with the third fluid chamber 93*a*, and the second fluid chamber 92*a* does not communicate with the fourth fluid chamber 94*a*. This configuration can suppress a varying inner pressure of the second fluid chamber 92*a* from affecting the fourth fluid chamber 94*a* or a varying inner pressure of the first fluid chamber 91*a* from affecting the third fluid chamber 93*a*. Therefore, the inner pressure of any of the first fluid chamber 91*a* to the fourth fluid chamber 94*a* containing the first bag 151*a* to the fourth bag 151*d*, respectively, is less likely to vary unless a corresponding one of the first bag 151*a* to the fourth bag 151*d* expands or shrinks. In this case, the inner pressure of the one of the first liquid chamber 91*b* to the fourth liquid chamber 94*b* which is disposed next to the corresponding one of the first fluid chamber 91*a* to the fourth fluid chamber 94*a* with the first flexible section 130*a* to the fourth flexible section 130*d* therebetween, respectively, is also less likely to vary.

As illustrated in FIG. 6, the liquid ejecting unit 1 further includes a first supply passage 140*a*, a first common liquid chamber 144*a*, a second supply passage 140*b*, a second common liquid chamber 144*b*, a third supply passage 140*c*, a third common liquid chamber 144*c*, a fourth supply passage 140*d*, and a fourth common liquid chamber 144*d*. The liquid ejecting unit 1 further includes a plurality of first independent flow passages 171*a*, a plurality of first energy generating chambers 174*a*, a plurality of first energy generating elements 161*a*, and a plurality of first communication flow passages 175*a*. The liquid ejecting unit 1 further includes a plurality of second independent flow passages 171*b*, a plurality of second energy generating chambers 174*b*, a plurality of second energy generating elements 161*b*, and a plurality of second communication flow passages 175*b*. The liquid ejecting unit 1 further includes a plurality of third independent flow passages 171*c*, a plurality of third energy generating chambers 174*c*, a plurality of third energy generating elements 161*c*, and a plurality of third communication flow passages 175*c*. The liquid ejecting unit 1 further includes a plurality of fourth independent flow passages 171*d*, a plurality of fourth energy generating chambers 174*d*, a plurality of fourth energy generating elements 161*d*, and a plurality of fourth communication flow passages 175*d*.

The first supply passage 140*a* allows the first liquid chamber 91*b* in the first chamber 91 to communicate with the first common liquid chamber 144*a*. Through the first supply passage 140*a*, the liquid stored in the first liquid chamber 91*b* in the first chamber 91 is supplied to the first ejection openings Nz1 in the first ejection opening row L1. The first common liquid chamber 144*a* that couples the first supply passage 140*a* to each of the first independent flow passages 171*a* has an angled Z1-side surface on which a first outlet 181*a* communicating with the outside is provided at the highest location. When the liquid flows into the first common liquid chamber 144*a* through the first supply passage 140*a*, bubbles contained in the liquid move up to the first outlet 181*a* and are discharged to the outside through the first outlet 181*a*.

The first independent flow passages 171*a* that are provided corresponding to the respective first ejection openings Nz1 allow the first common liquid chamber 144*a* to communicate with each of the first energy generating chambers 174*a*. The liquid in each of the first independent flow passages 171*a* is supplied to a corresponding one of the first energy generating chambers 174*a*.

The first energy generating chambers 174*a* are provided corresponding to the respective first ejection openings Nz1. The first energy generating elements 161*a* that are disposed on the walls of the respective first energy generating chambers 174*a* apply pressure to the liquid in the first energy generating chambers 174*a* in accordance with control signals from the circuit substrate 66 during the print operation. Then, the pressure applied to the liquid in the first energy generating chambers 174*a* is transmitted to the liquid in the first ejection openings Nz1 through the first communication flow passages 175*a*, thereby discharging the liquid to the outside through the first ejection openings Nz1.

As described above, the first liquid chamber 91*b* in the first chamber 91 leads to the first ejection openings Nz1 in the first ejection opening row L1.

The second supply passage 140*b* allows the second liquid chamber 92*b* in the second chamber 92 to communicate with the second common liquid chamber 144*b*. Through the second supply passage 140*b*, the liquid stored in the second liquid chamber 92*b* in the second chamber 92 is supplied to the second ejection openings Nz2 in the second ejection opening row L2. The second common liquid chamber 144*b* that couples the second supply passage 140*b* to each of the second independent flow passages 171*b* has an angled Z1-side surface on which a second outlet 181*b* communicating with the outside is provided at the highest location. When the liquid flows into the second common liquid chamber 144*b* through the second supply passage 140*b*, bubbles contained in the liquid move up to the second outlet 181*b* and are discharged to the outside through the second outlet 181*b*.

The second independent flow passages 171*b* that are provided corresponding to the respective second ejection openings Nz2 allow the second common liquid chamber 144*b* to communicate with each of the second energy generating chambers 174*b*. The liquid in each of the second independent flow passage 171*b* is supplied to a corresponding one of the second energy generating chambers 174*b*.

The second energy generating chambers 174*b* are provided corresponding to the respective second ejection openings Nz2. The second energy generating elements 161*b* that are disposed on the walls of the respective second energy generating chambers 174*b* apply pressure to the liquid in the second energy generating chambers 174*b* in accordance with control signals from the circuit substrate 66 during the print operation. Then, the pressure applied to the liquid in the second energy generating chambers 174*b* is transmitted to the liquid in the second ejection openings Nz2 through the second communication flow passages 175*b*, thereby discharging the liquid to the outside through the second ejection openings Nz2.

As described above, the second liquid chamber 92*b* in the second chamber 92 leads to the second ejection openings Nz2 in the second ejection opening row L2.

The third supply passage 140*c* allows the third liquid chamber 93*b* in the third chamber 93 to communicate with the third common liquid chamber 144*c*. Through the third supply passage 140*c*, the liquid stored in the third liquid chamber 93*b* in the third chamber 93 is supplied to the third ejection openings Nz3 in the third ejection opening row L3. The third common liquid chamber 144*c* that couples the third supply passage 140*c* to each of third independent flow passages 171*c* has an angled Z1-side surface on which a third outlet 181*c* communicating with the outside is provided at the highest location. When the liquid flows into the third common liquid chamber 144*c* through the third supply passage 140*c*, bubbles contained in the liquid move up to the third outlet 181*c* and are discharged to the outside through the third outlet 181*c*.

The third independent flow passages 171*c* that are provided corresponding to the respective third ejection openings Nz3 allow the third common liquid chamber 144*c* to communicate with each of the third energy generating chambers 174*c*. The liquid in each of the third independent flow passages 171*c* is supplied to a corresponding one of the third energy generating chambers 174*c*.

The third energy generating chambers 174*c* are provided corresponding to the respective third ejection openings Nz3. The third energy generating elements 161*c* that are disposed on the walls of the respective third energy generating chambers 174*c* apply pressure to the liquid in the third energy generating chambers 174*c* in accordance with control signals from the circuit substrate 66 during the print operation. Then, the pressure applied to the liquid in the third energy generating chambers 174*c* is transmitted to the liquid in the third ejection openings Nz3 through the third communication flow passages 175*c*, thereby discharging the liquid to the outside through the third ejection openings Nz3.

As described above, the third liquid chamber 93*b* in the third chamber 93 leads to the third ejection openings Nz3 in the third ejection opening row L3.

The fourth supply passage 140*d* allows the fourth liquid chamber 94*b* in the fourth chamber 94 to communicate with the fourth common liquid chamber 144*d*. Through the fourth supply passage 140*d*, the liquid stored in the fourth liquid chamber 94*b* in the fourth chamber 94 is supplied to the fourth ejection openings Nz4 in the fourth ejection opening row L4. The fourth common liquid chamber 144*d* that couples the fourth supply passage 140*d* to each of the fourth independent flow passages 171*d* has an angled Z1-side surface on which a fourth outlet 181*d* communicating with the outside is provided at the highest location. When the liquid flows into the fourth common liquid chamber 144*d* through the fourth supply passage 140*d*, bubbles contained in the liquid move up to the fourth outlet 181*d* and are discharged to the outside through the fourth outlet 181*d*.

The fourth independent flow passages 171*d* that are provided corresponding to the respective fourth ejection openings Nz4 allow the fourth common liquid chamber 144*d* to communicate with each of the fourth energy generating chambers 174*d*. The liquid in each of the fourth independent flow passages 171*d* is supplied to a corresponding one of the fourth energy generating chambers 174*d*.

The fourth energy generating chambers 174*d* are provided corresponding to the respective fourth ejection openings Nz4. The fourth energy generating elements 161*d* that are disposed on the walls of the respective fourth energy generating chambers 174*d* apply pressure to the liquid in the fourth energy generating chambers 174*d* in accordance with control signals from the circuit substrate 66 during the print operation. Then, the pressure applied to the liquid in the fourth energy generating chambers 174*d* is transmitted to the liquid in the fourth ejection openings Nz4 through the fourth communication flow passages 175*d*, thereby discharging the liquid to the outside through the fourth ejection openings Nz4.

As described above, the fourth liquid chamber 94*b* in the fourth chamber 94 leads to the fourth ejection openings Nz4 in the fourth ejection opening row L4.

Each liquid ejecting unit 1 further includes a configuration, not illustrated in FIG. 6, that will be described below. The first supply passage 140*a* also leads to the fifth ejection openings Nz5 in the fifth ejection opening row L5 of the third ejector 23. The second supply passage 140*b* also leads to the sixth ejection opening Nz6 in the sixth ejection opening row L6 of the third ejector 23. The third supply passage 140*c* also leads to the seventh ejection opening Nz7 in the seventh ejection opening row L7 of the fourth ejector 24. The fourth supply passage 140*d* also leads to the eighth ejection opening Nz8 in the eighth ejection opening row L8 of the fourth ejector 24.

Figure 10:
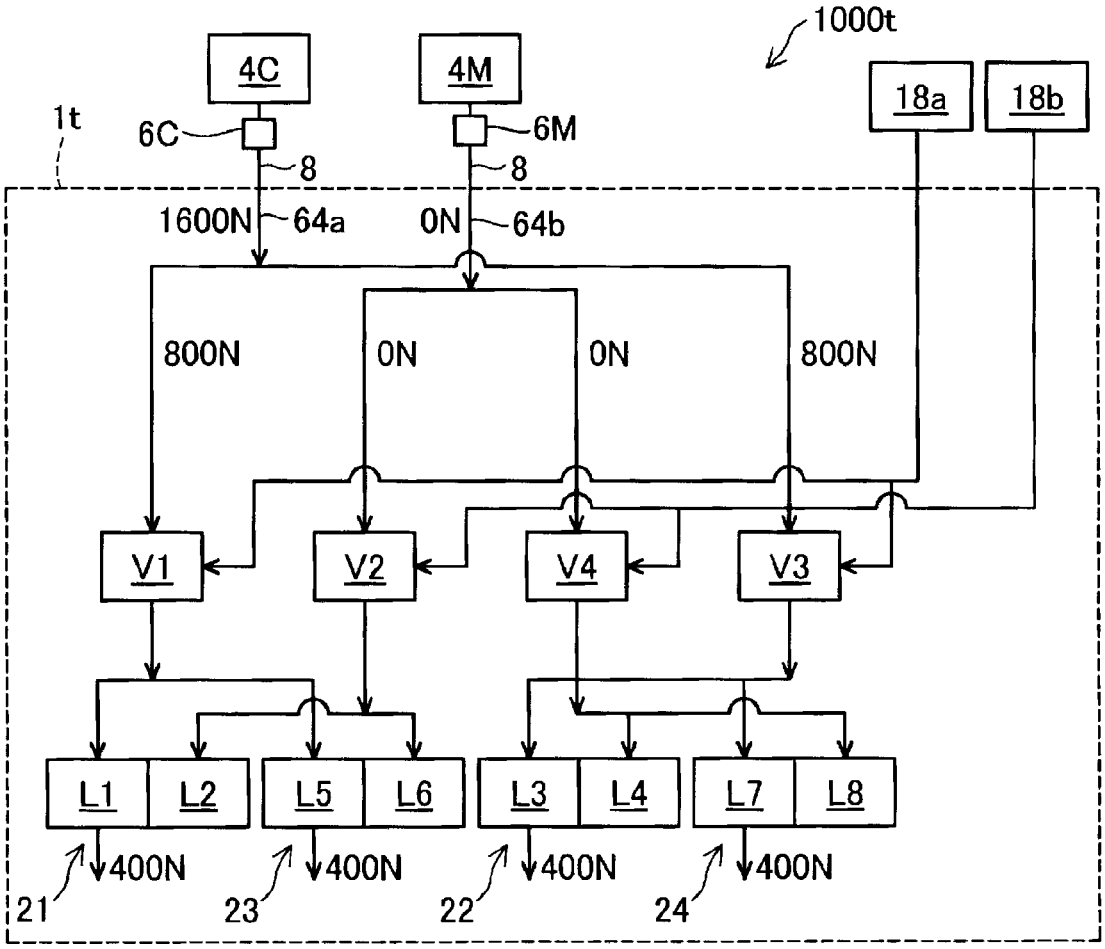
FIG. 10 illustrates a configuration of main flow passages in a liquid ejecting apparatus according to a reference example.

FIG. 10 illustrates a configuration of main flow passages in a liquid ejecting apparatus 1000*t* according to a reference example. In FIG. 10, the characters "1600N", "800N", "400N", and "0N" each indicate how many ejection openings Nz are present at the downstream ends of the liquid passage denoted thereby. For example, the character "1600N" indicates that 1600 ejection openings Nz are present at the downstream ends of the liquid passage. In the example that will be described below, a liquid ejecting unit 1*t* included in the liquid ejecting apparatus 1000*t* is configured to discharge cyan and magenta liquids, respectively, as the first and second types of liquids. In the liquid ejecting unit 1*t*, a first pressure regulator 18*a* opens a first sealing valve V1 and a third sealing valve V3 in order to supply the cyan ink to a first ejection opening row L1 in a first ejector 21, a fifth ejection opening row L5 in a third ejector 23, a third ejection opening row L3 in a second ejector 22, and a seventh ejection opening row L7 in a fourth ejector 24. Likewise, a second pressure regulator 18*b* opens both a second sealing valve V2 and a fourth sealing valve V4 in order to supply the magenta liquid to a second ejection opening row L2 in the first ejector 21, a sixth ejection opening row L6 in the third ejector 23, a fourth ejection opening row L4 in the second ejector 22, and an eighth ejection opening row L8 in the fourth ejector 24.

If pressure cleaning is performed for the liquid ejecting unit 1*t* in the liquid ejecting apparatus 1000*t*, for example, the first pressure regulator 18*a* supplies pressurized air to the liquid ejecting unit 1*t*, thereby forcedly opening both the first sealing valve V1 and the third sealing valve V3. Then, a liquid pressurizing and feeding mechanism 6C is driven to supply the cyan liquid from a liquid supply source 4C to the liquid ejecting unit 1*t*. As a result, the liquid ejecting unit 1*t* discharges the cyan liquid to the outside through ejection openings Nz in the first ejection opening row L1, the third ejection opening row L3, the fifth ejection opening row L5, and the seventh ejection opening row L7. In this case, if each of the first ejection opening row L1, the third ejection opening row L3, the fifth ejection opening row L5, and the seventh ejection opening row L7 has 400 ejection openings Nz, the liquid supply source 4C needs to feed the cyan liquid to total 1600 ejection openings Nz. As pressure cleaning is performed at one time for more ejection openings Nz in the liquid ejecting unit 1*t*, the liquid supply source 4C needs to feed larger amounts of liquid to a first liquid inlet 64*a* through the supply pipe 8 and the liquid ejecting unit 1*t* through the first liquid inlet 64*a*. Then, as larger amounts of liquid flow into the liquid ejecting apparatus 1000*t*, greater amounts of pressure are lost in the individual flow passages in the liquid ejecting apparatus 1000*t*. In this case, if the liquid pressurizing and feeding mechanism 6C is driven to supply the liquid at a constant pressure, the pressure of the liquid flowing in the liquid ejecting unit 1*t* decreases in proportional to the increasing pressure loss.

As described above, the first pressure regulator 18*a* opens both the first sealing valve V1 and the third sealing valve V3 when the liquid ejecting unit 1*t* discharges the cyan liquid to the outside through the ejection openings Nz in the first ejector 21 to the fourth ejector 24. Likewise, the second pressure regulator 18*b* opens both the second sealing valve V2 and the fourth sealing valve V4 when the liquid ejecting unit 1*t* discharges the cyan liquid to the outside through the ejection openings Nz in the first ejector 21 to the fourth ejector 24. In this case, the liquid supply source 4C and a liquid supply source 4M need to feed large amounts of liquids to many ejection openings Nz during the pressure cleaning. This may hinder the liquids from flowing at sufficiently high rates in the liquid ejecting unit 1*t*, in which case the pressure cleaning cannot be performed effectively.

Figure 11:
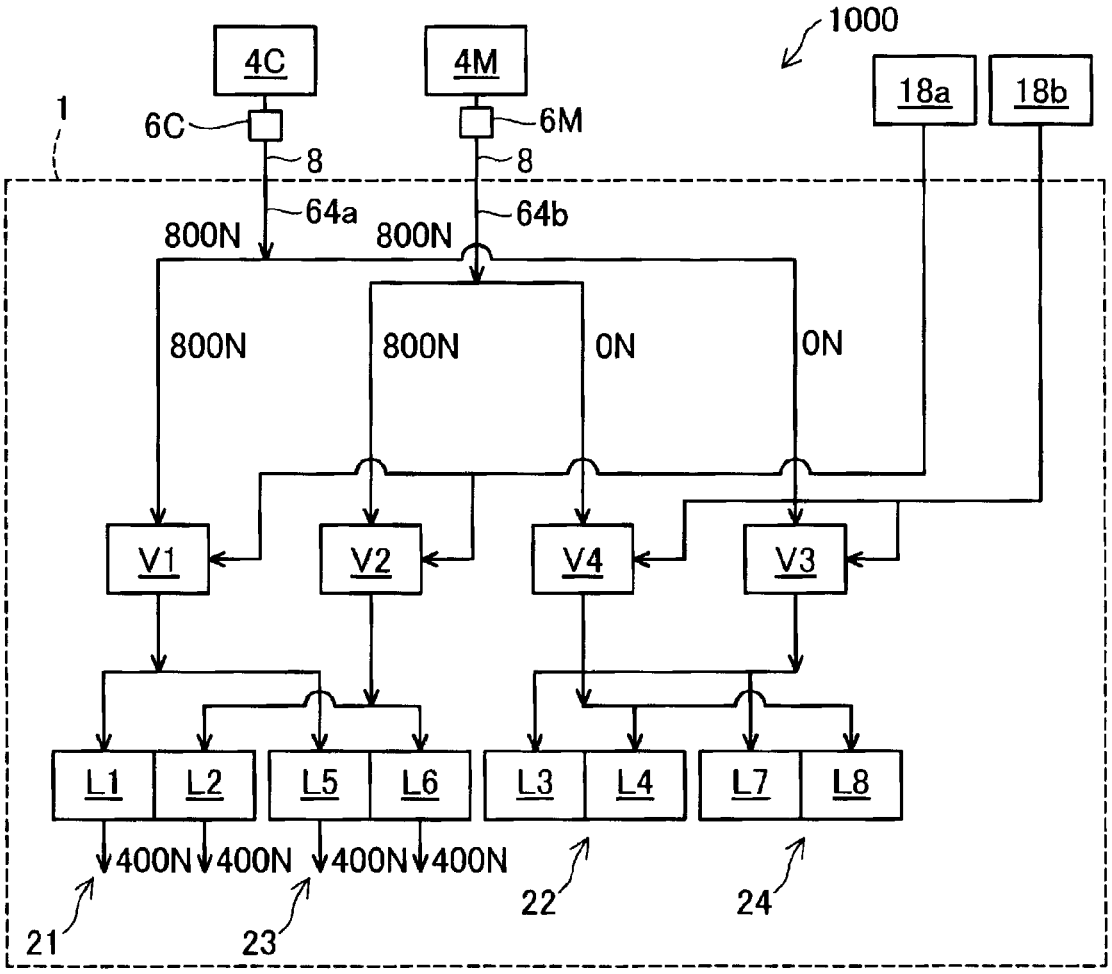
FIG. 11 illustrates a configuration of main flow passages in the liquid ejecting apparatus according to the first embodiment.

FIG. 11 illustrates a configuration of main flow passages in the liquid ejecting apparatus 1000 described above. In FIG. 11, the characters "800N", "400N", and "0N" each indicate how many ejection openings Nz are present at the downstream ends of the liquid passage denoted thereby. For example, the character "800N" indicates that 800 ejection openings Nz are present at the downstream ends of the liquid passage. In the example that will be described below, a liquid ejecting unit 1 in the liquid ejecting apparatus 1000 is configured to discharge cyan and magenta liquids, respectively, as the first and second types of liquids.

In the liquid ejecting unit 1, the first pressure regulator 18*a* opens both the first sealing valve V1 and the second sealing valve V2 in order to supply the cyan liquid to the first ejection opening row L1 and the second ejection opening row L2 in the first ejector 21 and the fifth ejection opening row L5 and the sixth ejection opening row L6 in the third ejector 23. Likewise, the second pressure regulator 18*b* opens both the fourth sealing valve V4 and the third sealing valve V3 in order to supply the magenta liquid to the third ejection opening row L3 and the fourth ejection opening row L4 in the second ejector 22 and the seventh ejection opening row L7 and the eighth ejection opening row L8 in the fourth ejector 24.

If pressure cleaning is performed for the liquid ejecting unit 1 in the liquid ejecting apparatus 1000, for example, the first pressure regulator 18*a* supplies the pressurized air to the liquid ejecting unit 1, thereby forcedly opening both the first sealing valve V1 and the second sealing valve V2. Then, the liquid pressurizing and feeding mechanism 6C supplies the cyan liquid from the liquid supply source 4C to the liquid ejecting unit 1. As a result, the liquid ejecting unit 1 discharges the cyan liquid to the outside through ejection openings Nz in the first ejection opening row L1 and the fifth ejection opening row L5. In this case, since each of the first ejection opening row L1 and the fifth ejection opening row L5 has 400 ejection openings Nz, the liquid supply source 4C needs to feed the cyan liquid to total 800 ejection openings Nz. In turn, the liquid pressurizing and feeding mechanism 6M supplies the magenta liquid from the liquid supply source 4M to the liquid ejecting unit 1. As a result, the liquid ejecting unit 1 discharges the magenta liquid to the outside through ejection openings Nz in the second ejection opening row L2 and the sixth ejection opening row L6. In this case, since each of the second ejection opening row L2 and the sixth ejection opening row L6 has 400 ejection openings Nz, the liquid supply source 4C needs to feed the magenta liquid to total 800 ejection openings Nz. In short, the ejection openings Nz to which each of the liquid supply sources 4C and 4M in the liquid ejecting apparatus 1000 needs to feed the liquid at one time during the pressure cleaning are half as many as those in the liquid ejecting apparatus 1000*t*, described above, according to the reference example. In this case, pressure loss for the liquid becomes lower in each supply pipe 8 and the liquid ejecting unit 1 because smaller amounts of liquid flow therein. Therefore, the liquids flow in the liquid ejecting unit 1 at higher rates, allowing the pressure cleaning to be performed efficiently. Moreover, since the ejection openings Nz to which each of the liquid supply source 4C and 4M in the liquid ejecting apparatus 1000 needs to feed the liquid at one time during the pressure cleaning are half as many as those in the liquid ejecting apparatus 1000*t*, each of the liquid pressurizing and feeding mechanisms 6C to 6K can apply sufficient pressure to the first liquid passage 101 or the second liquid passage 102 by means of lower driving power. In this embodiment, these effects are produced by the pressure cleaning mechanism for the liquid ejecting apparatus 1000; it is, however, obvious that they can also be produced by any given mechanism for applying pressure to passages and ejection openings.

Second Embodiment

Figure 12:
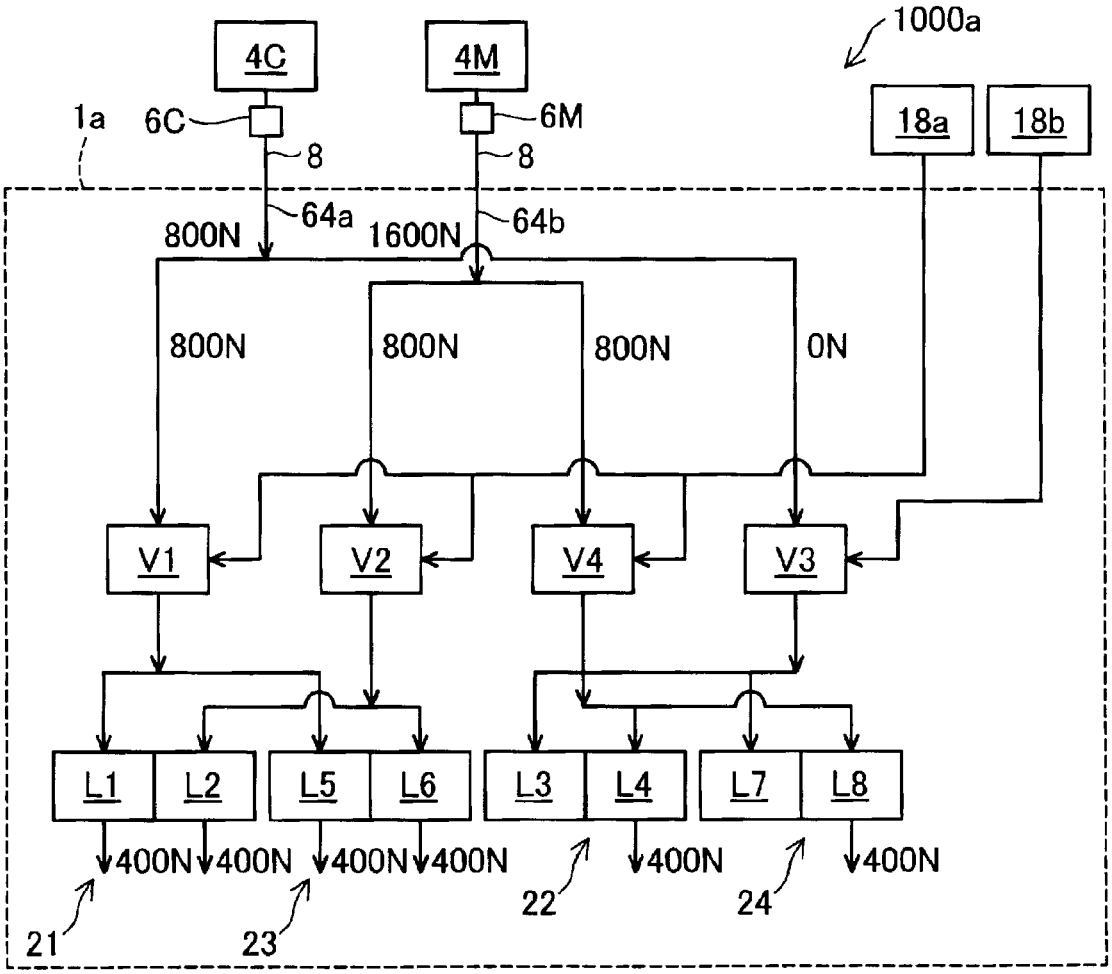
FIG. 12 illustrates a configuration of main flows passage in a liquid ejecting apparatus according to a second embodiment of the present disclosure.

FIG. 12 illustrates a configuration of main flow passages in the liquid ejecting apparatus 1000*a* according to a second embodiment of the present disclosure. The liquid ejecting apparatus 1000*a* differs from the liquid ejecting apparatus 1000, illustrated in FIG. 11, according to the foregoing first embodiment, in that a first pressure regulator 18*a* controls the opening and closing operations of a first sealing valve V1, a second sealing valve V2, and a fourth sealing valve V4, and a second pressure regulator 18*b* controls the opening and closing operations of a third sealing valve V3. In the liquid ejecting apparatus 1000*a*, a liquid supply source 4M feeds the liquid to 1600 ejection openings Nz, whereas a liquid supply source 4C feeds the liquid to 800 ejection openings Nz. It should be noted that components in the second embodiment which are identical to those in the first embodiment are given the same characters and will not be described as appropriate.

As described above, the liquid supply source 4M feeds the liquid to 1600 ejection openings Nz. Thus, the rate at which the liquid supply source 4M feeds the liquid to a liquid ejecting unit 1*a* in the liquid ejecting apparatus 1000*a* is lower than that at which the liquid supply source 4C feeds the liquid to the liquid ejecting unit 1*a*. In this case, when the pressure cleaning is performed for the liquid ejecting unit 1*a* in the liquid ejecting apparatus 1000*a*, it is possible to change the number of ejection openings Nz to which the individual liquids are to be supplied from liquid supply sources 4C to 4K, depending on their properties. In this way, the pressure cleaning can be performed depending on the properties of the liquids. If liquids stored in the liquid supply sources 4C to 4K are viscous and thus prone to being solidified easily, for example, the number of ejection openings Nz to which the individual liquids are to be supplied may be decreased so that the liquids flow in the liquid ejecting unit 1*a* at higher rates. In this case, it is possible to the pressure cleaning effectively by removing impurities of the solidified liquid from passages and ejection openings Nz. On the other hand, if liquids stored in the liquid supply sources 4C to 4K are less viscous and thus less prone to being solidified easily, for example, the number of ejection openings Nz to which the individual liquids are to be supplied may be increased so that the liquids flow at lower rates. Even in this case, it is possible to the pressure cleaning effectively because only small amounts of impurities of the solidified liquid are present in passages and ejection openings Nz. By changing the number of ejection openings Nz to which the liquids stored in the liquid supply sources 4C to 4K are to be fed depending on their properties, it is possible to decrease the amounts of the liquids to be exhausted during the pressure cleaning with a minimal risk of failures to discharge the liquids.

First Modification

In each liquid ejecting unit 1 of the liquid ejecting apparatus 1000 according to the first embodiment and the liquid ejecting apparatus 1000*a* according to the second embodiment, the first fluid chamber 91*a* to the fourth fluid chamber 94*a* are provided with, respectively, the first opening/closing mechanism 150*a* to the fourth opening/closing mechanism 150*d*. In addition, the first exposure-to-air passage 120*a* to the fourth exposure-to-air passage 120*d* are provided, respectively, in relation to the first fluid chamber 91*a* to the fourth fluid chamber 94*a*. However, this configuration is not limiting. As an alternative example, exposure-to-air passages may be provided for respective units in which the pressure cleaning is to be performed. As another alternative example, if the first fluid chamber 91*a* communicates with the third fluid chamber 93*a*, a common exposure-to-air passage may be provided for both the first fluid chamber 91*a* and the third fluid chamber 93*a*. This can suppress the inner pressures of the second fluid chamber 92*a* and the fourth fluid chamber 94*a* from varying in response to the warping of the first flexible section 130*a* in the first fluid chamber 91*a* and the third flexible section 130*c* in the third fluid chamber 93*a*. Consequently, it is possible to achieve a liquid ejecting unit with a minimal number of exposure-to-air passages. In this case, (the number of sealing valves)/(unit of pressure cleaning) may be equal to or less than the number of exposure-to-air passages, where the unit of pressure cleaning represents the number of sealing valves to be controlled, at one time, in terms of the opening and closing operations during the pressure cleaning.

Second Modification

Each liquid ejecting unit 1 in the liquid ejecting apparatus 1000 according to the first embodiment and the liquid ejecting apparatus 1000*a* according to the second embodiment is provided with the liquid supply sources 4C to 4K that contain liquids having the different types and colors; however, this configuration is not limiting. As an alternative example, these liquids may have different types but the same color: one of the liquids may contain a black pigment, whereas the other may contain a black dye. As an alternative example, the liquids may have the same hue but different lightnesses: one of the liquids may contain a color material, whereas the other may contain no color material.

Third Modification

In each liquid ejecting unit 1 of the liquid ejecting apparatus 1000 according to the first embodiment and the liquid ejecting apparatus 1000*a* according to the second embodiment, the pressurized air flows through the first fluid passage 81 and the second fluid passage 82; however, another type of fluid, such as water or another type of liquid may pass through the first fluid passage 81 and the second fluid passage 82.

Other Modifications

The present disclosure is not limited to the foregoing embodiments and modifications and may be implemented by various aspects within the scope of the claims. For example, the present disclosure may be implemented by the aspects that will be described below. The technical components in the foregoing embodiments and modifications which are equivalent to those in the aspects may be replaced or combined as appropriate in order to address one or more disadvantages in the present disclosure or produce one or more effects of the present disclosure. Furthermore, some technical components may be deleted as appropriate unless they are described as being important herein.

A first aspect of the present disclosure is a liquid ejecting unit that includes: a first chamber; a second chamber differing from the first chamber; a third chamber differing from the first chamber and the second chamber; and a fourth chamber differing from the first chamber, the second chamber, and the third chamber. Furthermore, the liquid ejecting unit includes: a first liquid passage through which a first type of liquid is supplied to both the first chamber and the third chamber; a second liquid passage through which a second type of liquid is supplied to both the second chamber and the fourth chamber, the second type of liquid differing from the first type of liquid; a first fluid passage through which fluid is supplied to both the first chamber and the second chamber; and a second fluid passage through which the fluid is supplied to both the third chamber and the fourth chamber.

When the fluid is supplied to both the first chamber and the second chamber through the first fluid passage, for example, the first chamber communicates with the first liquid passage, and the second chamber communicates with the second liquid passage. In this configuration, when pressure cleaning is performed for the passages and the ejection openings, the first or second type of liquid does not have to be supplied to many ejection openings at one time. Consequently, it is possible to provide pressure to the first type of liquid in the first liquid passage and the second type of liquid in the second liquid passage with decreased driving power.

The above liquid ejecting unit may further include a first flexible section, a second flexible section, a third flexible section, a fourth flexible section, a first sealing valve, a second sealing valve, a third sealing valve, and a fourth sealing valve. The first flexible section that is warped by the fluid supplied through the first fluid passage may be disposed inside the first chamber. The second flexible section that is warped by the fluid supplied through the first fluid passage may be disposed inside the second chamber. The third flexible section that is warped by the fluid supplied through the second fluid passage may be disposed inside the third chamber. The fourth flexible section that is warped by the fluid supplied through the second fluid passage may be disposed inside the fourth chamber. The first sealing valve may switch between a state in which the first liquid passage communicates with the first chamber and a state in which the first liquid passage does not communicate with the first chamber, in response to warping of the first flexible section. The second sealing valve may switch between a state in which the second liquid passage communicates with the second chamber and a state in which the second liquid passage does not communicate with the second chamber, in response to warping of the second flexible section. The third sealing valve may switch between a state in which the first liquid passage communicates with the third chamber and a state in which the first liquid passage does not communicate with the third chamber, in response to warping of the third flexible section. The fourth sealing valve may switch between a state in which the second liquid passage communicates with the fourth chamber and a state in which the second liquid passage does not communicate with the fourth chamber, in response to warping of the fourth flexible section.

When pressure cleaning using the first type of liquid is performed for the passages and the ejection openings, the fluid may be supplied to the first chamber and the second chamber through the first fluid passage, and the first sealing valve and the second sealing valve thereby may be opened. Then, the first type of liquid may be supplied from the first chamber to the corresponding ejection openings, whereas the second type of liquid may be supplied from the second chamber to the corresponding ejection openings. Likewise, when pressure cleaning using the second type of liquid is performed for the passages and the ejection openings, the fluid may be supplied to the third chamber and the fourth chamber through the second fluid passage, and the third sealing valve and the fourth sealing valve thereby may be opened. Then, the first type of liquid may be supplied from the third chamber to the corresponding ejection openings, whereas the second type of liquid may be supplied from the fourth chamber to the corresponding ejection opening. In this configuration, when pressure cleaning is performed for the passages and the ejection openings, the first or second type of liquid does not have to be supplied to many ejection openings at one time. Consequently, it is possible to provide pressure to the first type of liquid in the first liquid passage and the second type of liquid in the second liquid passage with decreased driving power.

The above liquid ejecting unit may further include: a first ejector having a first ejection opening row and a second ejection opening row; and a second ejector having a third ejection opening row and a fourth ejection opening row. The first ejection opening row may include a plurality of first ejection openings that communicate with the first chamber. The second ejection opening row may include a plurality of second ejection openings that communicate with the second chamber. The third ejection opening row may include a plurality of third ejection openings that communicate with the third chamber. The fourth ejection opening row may include a plurality of fourth ejection openings that communicate with the fourth chamber.

In the above configuration, when pressure cleaning using the first type of liquid is performed for the passage and the ejection openings, the fluid may be supplied to the first chamber and the second chamber through the first fluid passage, and the first sealing valve and the second sealing valve thereby may be opened. Then, the first type of liquid may be supplied from the first chamber to the corresponding ejection openings, whereas the second type of liquid may be supplied from the second chamber to the corresponding ejection opening. Likewise, when pressure cleaning using the second type of liquid is performed for the passage and the ejection openings, the fluid may be supplied to the third chamber and the fourth chamber through the second fluid passage, and the third sealing valve and the fourth sealing valve thereby may be opened. Then, the first type of liquid may be supplied from the third chamber to the corresponding ejection openings, whereas the second type of liquid may be supplied from the fourth chamber to the corresponding ejection opening. In this configuration, when pressure cleaning is performed for the passages and the ejection openings, the first or second type of liquid does not have to be supplied to many ejection openings at one time. Consequently, it is possible to provide pressure to the first type of liquid in the first liquid passage and the second type of liquid in the second liquid passage with decreased driving power.

The above liquid ejecting unit may further include a holder to which the first ejector and the second ejector are fixed. The first ejector may be an ejection head, and the second ejector may be an ejection head.

In the above configuration, pressure cleaning can be performed for the passage and the ejection openings in units of the ejection heads.

In the above liquid ejecting unit, the first chamber may include a first liquid chamber coupled to the first liquid passage and a first fluid chamber coupled to the first fluid passage; the first liquid chamber may be separated from the first fluid chamber by the first flexible section. The second chamber may include a second liquid chamber coupled to the second liquid passage and a second fluid chamber coupled to the first fluid passage; the second liquid chamber may be separated from the second fluid chamber by the second flexible section. The third chamber may include a third liquid chamber coupled to the first liquid passage and a third fluid chamber coupled to the second fluid passage; the third liquid chamber may be separated from the third fluid chamber by the third flexible section. The fourth chamber may include a fourth liquid chamber coupled to the second liquid passage and a fourth fluid chamber coupled to the second fluid passage; the fourth liquid chamber may be separated from the fourth fluid chamber by the fourth flexible section. The first fluid chamber may not communicate with the third fluid chamber. The second fluid chamber may not communicate with the fourth fluid chamber.

The above configuration can reduce an influence that a varying pressure in one of the first fluid chamber and the third fluid chamber exerts over the other. Likewise, the configuration can reduce an influence that a varying pressure in one of the second fluid chamber and the fourth fluid chamber exerts over the other.

In the above liquid ejecting unit, the first type of liquid and the second type of liquid may have different colors.

In the above configuration, liquids of different colors can be used.

A second aspect of the present disclosure is a liquid ejecting apparatus. This liquid ejecting apparatus includes: a liquid ejecting unit; and a controller that controls an operation of the liquid ejecting unit. The liquid ejecting unit includes: a first chamber; a second chamber differing from the first chamber; a third chamber differing from the first chamber and the second chamber; and a fourth chamber differing from the first chamber, the second chamber, and the third chamber. Furthermore, the liquid ejecting unit includes: a first liquid passage through which a first type of liquid is supplied to both the first chamber and the third chamber; a second liquid passage through which a second type of liquid is supplied to both the second chamber and the fourth chamber, the second type of liquid differing from the first type of liquid; a first fluid passage through which fluid is supplied to both the first chamber and the second chamber, the first fluid passage being coupled to both the first chamber and the second chamber; and a second fluid passage through which the fluid is supplied to both the third chamber and the fourth chamber, the second fluid passage being coupled to both the third chamber and the fourth chamber.

In the above configuration, the fluid is supplied to the first chamber to which the first type of liquid is supplied and the second chamber to which the second type of liquid is supplied, through the first fluid passage. Likewise, the fluid is supplied to the third chamber to which the first type of liquid is supplied and the fourth chamber to which the second type of liquid is supplied, through the second fluid passage. When the fluid is supplied to both the first chamber and the second chamber through the first fluid passage, for example, the first chamber communicates with the first liquid passage, and the second chamber communicates with the second liquid passage. Therefore, when pressure clean using the first type of liquid is performed, for example, the first type of liquid does not have to be supplied to ejection openings to which both the first chamber and the third chamber lead. Instead, the first type of liquid only has to be supplied to ejection openings to which only the first chamber leads. In this configuration, when pressure cleaning is performed for the passages and the ejection openings, the first or second type of liquid does not have to be supplied to many ejection openings at one time. Consequently, it is possible to provide pressure to the first type of liquid in the first liquid passage and the second type of liquid in the second liquid passage with decreased driving power.

The present disclosure can be implemented by various aspects, including a liquid ejecting unit and a liquid ejecting apparatus. Examples of the aspects includes: a method of applying pressure to passages and ejection openings; a method of performing pressure cleaning; and a non-transitory computer-readable storage medium that stores programs for such methods.

What is claimed is:

1. A liquid ejecting unit comprising:

a first chamber;

a second chamber differing from the first chamber;

a third chamber differing from the first chamber and the second chamber;

a fourth chamber differing from the first chamber, the second chamber, and the third chamber;

a first liquid passage for supplying a first type of liquid to the first chamber and the third chamber;

a second liquid passage for supplying a second type of liquid to the second chamber and the fourth chamber, the second type of liquid differing from the first type of liquid;

a first fluid passage for supplying fluid to the first chamber and the second chamber; and a second fluid passage for supplying the fluid to the third chamber and the fourth chamber.

2. The liquid ejecting unit according to claim 1, further comprising:

a first flexible section that is warped by the fluid supplied through the first fluid passage, the first flexible section being disposed inside the first chamber;

a second flexible section that is warped by the fluid supplied through the first fluid passage, the second flexible section being disposed inside the second chamber;

a third flexible section that is warped by the fluid supplied through the second fluid passage, the third flexible section being disposed inside the third chamber;

a fourth flexible section that is warped by the fluid supplied through the second fluid passage, the fourth flexible section being disposed inside the fourth chamber;

a first sealing valve that switches between a state in which the first liquid passage communicates with the first chamber and a state in which the first liquid passage does not communicate with the first chamber, in response to warping of the first flexible section;

a second sealing valve that switches between a state in which the second liquid passage communicates with the second chamber and a state in which the second liquid passage does not communicate with the second chamber, in response to warping of the second flexible section;

a third sealing valve that switches between a state in which the first liquid passage communicates with the third chamber and a state in which the first liquid passage does not communicate with the third chamber, in response to warping of the third flexible section; and a fourth sealing valve that switches between a state in which the second liquid passage communicates with the fourth chamber and a state in which the second liquid passage does not communicate with the fourth chamber, in response to warping of the fourth flexible section.

3. The liquid ejecting unit according to claim 2, further comprising:

a first ejector having a first ejection opening row and a second ejection opening row; and a second ejector having a third ejection opening row and a fourth ejection opening row, wherein the first ejection opening row includes a plurality of first ejection openings that communicate with the first chamber, the second ejection opening row includes a plurality of second ejection openings that communicate with the second chamber, the third ejection opening row includes a plurality of third ejection openings that communicate with the third chamber, and the fourth ejection opening row includes a plurality of fourth ejection openings that communicate with the fourth chamber.

4. The liquid ejecting unit according to claim 3, further comprising a holder to which the first ejector and the second ejector are fixed, wherein the first ejector is an ejection head, and the second ejector is an ejection head.

5. The liquid ejecting unit according to claim 4, wherein the first chamber includes a first liquid chamber coupled to the first liquid passage and a first fluid chamber coupled to the first fluid passage, the first liquid chamber being separated from the first fluid chamber by the first flexible section, the second chamber includes a second liquid chamber coupled to the second liquid passage and a second fluid chamber coupled to the first fluid passage, the second liquid chamber being separated from the second fluid chamber by the second flexible section, the third chamber includes a third liquid chamber coupled to the first liquid passage and a third fluid chamber coupled to the second fluid passage, the third liquid chamber being separated from the third fluid chamber by the third flexible section, the fourth chamber includes a fourth liquid chamber coupled to the second liquid passage and a fourth fluid chamber coupled to the second fluid passage, the fourth liquid chamber being separated from the fourth fluid chamber by the fourth flexible section, the first fluid chamber does not communicate with the third fluid chamber, and the second fluid chamber does not communicate with the fourth fluid chamber.

6. The liquid ejecting unit according to claim 3, wherein the first chamber includes a first liquid chamber coupled to the first liquid passage and a first fluid chamber coupled to the first fluid passage, the first liquid chamber being separated from the first fluid chamber by the first flexible section, the second chamber includes a second liquid chamber coupled to the second liquid passage and a second fluid chamber coupled to the first fluid passage, the second liquid chamber being separated from the second fluid chamber by the second flexible section, the third chamber includes a third liquid chamber coupled to the first liquid passage and a third fluid chamber coupled to the second fluid passage, the third liquid chamber being separated from the third fluid chamber by the third flexible section, the fourth chamber includes a fourth liquid chamber coupled to the second liquid passage and a fourth fluid chamber coupled to the second fluid passage, the fourth liquid chamber being separated from the fourth fluid chamber by the fourth flexible section, the first fluid chamber does not communicate with the third fluid chamber, and the second fluid chamber does not communicate with the fourth fluid chamber.

7. The liquid ejecting unit according to claim 2, wherein the first chamber includes a first liquid chamber coupled to the first liquid passage and a first fluid chamber coupled to the first fluid passage, the first liquid chamber being separated from the first fluid chamber by the first flexible section, the second chamber includes a second liquid chamber coupled to the second liquid passage and a second fluid chamber coupled to the first fluid passage, the second liquid chamber being separated from the second fluid chamber by the second flexible section, the third chamber includes a third liquid chamber coupled to the first liquid passage and a third fluid chamber coupled to the second fluid passage, the third liquid chamber being separated from the third fluid chamber by the third flexible section, the fourth chamber includes a fourth liquid chamber coupled to the second liquid passage and a fourth fluid chamber coupled to the second fluid passage, the fourth liquid chamber being separated from the fourth fluid chamber by the fourth flexible section, the first fluid chamber does not communicate with the third fluid chamber, and the second fluid chamber does not communicate with the fourth fluid chamber.

8. The liquid ejecting unit according to claim 1, wherein the first type of liquid and the second type of liquid have different colors.

9. The liquid ejecting apparatus comprising:

a liquid ejecting unit; and a controller controlling an operation of the liquid ejecting unit, the liquid ejecting unit including:

a first chamber;

a second chamber differing from the first chamber;

a third chamber differing from the first chamber and the second chamber;

a fourth chamber differing from the first chamber, the second chamber, and the third chamber;

a first liquid passage for supplying a first type of liquid to the first chamber and the third chamber;

a second liquid passage for supplying a second type of liquid to the second chamber and the fourth chamber, the second type of liquid differing from the first type of liquid;

a first fluid passage for supplying fluid to the first chamber and the second chamber, the first fluid passage being coupled to the first chamber and the second chamber; and a second fluid passage for supplying the fluid to the third chamber and the fourth chamber, the second fluid passage being coupled to the third chamber and the fourth chamber.

* * * * *